US009003857B2

(12) United States Patent
Nonomura et al.

(10) Patent No.: US 9,003,857 B2
(45) Date of Patent: Apr. 14, 2015

(54) PRESS-FORMING METHOD AND PRESS-FORMED PART

(75) Inventors: Kiyoshi Nonomura, Nissin (JP); Hiroshi Sato, Toyota (JP); Hideaki Ikezawa, Okazaki (JP); Yuki Ishiguro, Chiryu (JP); Masashi Ozawa, Nagoya (JP)

(73) Assignees: Toyota Jidosha Kabushiki Kaisha, Toyota-shi (JP); Aisin Takaoka Co., Ltd., Toyota-shi (JP)

( * ) Notice: Subject to any disclaimer, the term of this patent is extended or adjusted under 35 U.S.C. 154(b) by 560 days.

(21) Appl. No.: 12/811,222

(22) PCT Filed: May 14, 2009

(86) PCT No.: PCT/IB2009/005606

§ 371 (c)(1),
(2), (4) Date: Jun. 30, 2010

(87) PCT Pub. No.: WO2009/138869

PCT Pub. Date: Nov. 19, 2009

(65) Prior Publication Data

US 2010/0285328 A1 Nov. 11, 2010

(30) Foreign Application Priority Data

May 16, 2008 (JP) ..... 2008-129784

(51) Int. Cl.
*B21D 37/16* (2006.01)
*C21D 1/42* (2006.01)
(Continued)

(52) U.S. Cl.
CPC ..... *B21D 37/16* (2013.01); *B21D 22/02* (2013.01); *C21D 1/34* (2013.01); *C21D 1/40* (2013.01); *C21D 1/673* (2013.01)

(58) Field of Classification Search
CPC .... B21D 22/022; B21D 22/208; B21D 37/16; C21D 1/34; C21D 1/42; C21D 1/673
USPC ..... 72/342.1, 342.2, 342.5, 342.6, 342.94, 72/342.96; 148/644, 654, 660, 639, 643, 148/566, 574; 219/50, 154, 162, 647, 660
See application file for complete search history.

(56) References Cited

U.S. PATENT DOCUMENTS 2,038,415 A * 4/1936 Claisse ..... 148/566
2,384,674 A * 9/1945 Hallewell ..... 72/342.96
(Continued)

FOREIGN PATENT DOCUMENTS

JP 59-150623 * 8/1984 ..... B21D 22/26
JP 2002 248525 9/2002
(Continued)

*Primary Examiner* — Edward Tolan
(74) *Attorney, Agent, or Firm* — Oblon, McClelland, Maier & Neustadt, L.L.P.

(57) ABSTRACT

A current density changing portion is formed in a heating process on an upper base side with respect to a center portion of a flat metal plate in a direction of current flow, by passing current from a lower base side to the upper base side of the flat metal plate which is rectangular when viewed from above. As a result, a quenchable portion is formed on the upper base side with respect to the center portion of the flat metal plate in the direction of current flow, and a non-quenchable portion is formed on the lower base side with respect to the center portion of the flat metal plate in the direction of current flow. The flat metal plate is press-formed after the heating process, so a complex die cooling structure is not necessary during press-forming, which enables the die cost to be reduced.

11 Claims, 18 Drawing Sheets

(51) Int. Cl.

| | |
|---|---|
| ***B21D 22/02*** | (2006.01) |
| ***C21D 1/34*** | (2006.01) |
| ***C21D 1/40*** | (2006.01) |
| ***C21D 1/673*** | (2006.01) |

(56) References Cited

U.S. PATENT DOCUMENTS

| | | | | |
|---|---|---|---|---|
| 2,915,813 | A * | 12/1959 | White | 428/577 |
| 3,703,093 | A * | 11/1972 | Komatsu et al. | 72/342.4 |
| 3,737,618 | A * | 6/1973 | Arnosky | 219/156 |
| 4,010,969 | A * | 3/1977 | Cantrell et al. | 293/102 |
| 4,356,717 | A * | 11/1982 | Okunishi et al. | 72/342.3 |
| 5,657,922 | A * | 8/1997 | Lowery et al. | 228/144 |
| 6,033,499 | A * | 3/2000 | Mitra | 148/688 |
| 6,185,977 | B1 * | 2/2001 | Schiessl et al. | 72/342.1 |
| 6,463,779 | B1 | 10/2002 | Terziakin | |
| 6,742,374 | B2 * | 6/2004 | Ozawa | 72/342.5 |
| 6,897,407 | B2 | 5/2005 | Gomez | |
| 6,903,296 | B2 | 6/2005 | Gomez | |
| 6,918,224 | B2 * | 7/2005 | Tjoelker et al. | 52/745.19 |
| 7,077,920 | B2 * | 7/2006 | Gehringhoff | 148/530 |
| 7,260,972 | B2 * | 8/2007 | Krajewski | 72/379.2 |
| 7,451,630 | B2 * | 11/2008 | Tjoelker et al. | 72/342.5 |
| 7,523,850 | B2 * | 4/2009 | Barnes | 228/112.1 |
| 7,714,253 | B2 * | 5/2010 | Machrowicz | 219/162 |
| 2002/0113041 | A1 | 8/2002 | Ozawa | |
| 2007/0215588 | A1 | 9/2007 | Machrowicz | |
| 2009/0158587 | A1 * | 6/2009 | McKimpson et al. | 29/888.011 |
| 2009/0166353 | A1 * | 7/2009 | Rudnev et al. | 219/660 |
| 2010/0072192 | A1 * | 3/2010 | Hirota | 219/647 |

FOREIGN PATENT DOCUMENTS

| | | |
|---|---|---|
| JP | 2008 133523 | 6/2006 |
| JP | 2006 289425 | 10/2006 |
| JP | 2007 75834 | 3/2007 |
| WO | 00 74441 | 12/2000 |

* cited by examiner

PRESS-FORMING METHOD AND PRESS-FORMED PART

BACKGROUND OF THE INVENTION

1. Field of the Invention

The invention relates to a press-forming method in which a desired portion of a formed part can be quenched, as well as a press-formed part using a plate manufactured according to this kind of press-forming method.

2. Description of the Related Art

Japanese Patent Application Publication No. 2007-75834 (JP-A-2007-75834) describes a hot press-forming die for press-forming metal plate. A coolant supply discharge port that opens on the side of the forming surface is formed in the hot press-forming die. This coolant discharge port is connected to a coolant supply conduit and is able to discharge coolant. Also, a concave portion that opens on the forming surface is formed on the hot press-forming die. The cooling effects from the coolant discharged from the coolant discharge port and the concave portion enable the strength of the hot press-formed part to be changed in steps.

However, the hot press-forming die described in JP-A-2007-75834 must be provided with a complex die cooling structure formed by the coolant supply conduit and the concave portion described above, and what is more, the hot press-forming die is only able to change the strength of the hot press-formed part in steps.

SUMMARY OF THE INVENTION

This invention thus provides a press-forming method which quenches a desired portion without making the die structure complex, as well as a press-formed part obtained by that press-forming method.

A first aspect of the invention relates to a press-forming method that includes i) a heating process of connecting an electrode to one end of a plate in a direction orthogonal to the thickness direction of the plate and connecting another electrode to the other end of the plate in the direction orthogonal to the thickness direction of the plate, and heating the plate by passing current from the one end to the other end, and controlling the temperature distribution of the plate while the current is passing through the plate by establishing, in the plate, a current density changing portion where the current density in the plate is different than the current density at another portion while current is passing through the plate; and ii) a forming process of forming the plate into a predetermined shape by pressing and cooling the plate which has been heated in the heating process.

With this press-forming method, in the heating process, an electrode is connected to one end of the plate in a direction orthogonal to the thickness direction of the plate and another electrode is connected to the other end of the plate in the direction orthogonal to the thickness direction of the plate, and current is passed through the plate. Passing current through the plate in this way heats the plate. The plate that has been heated in the heating process in this way is then formed into a desired shape by being pressed and cooled in a forming process.

Here, a current density changing portion where the current density is different than it is at another portion while the current is passing through the plate is established in the plate. As a result, the plate is not heated uniformly. Instead, the plate is heated with a temperature distribution corresponding to the region where the current density changing portion is established. When the plate that has been heated in this way is press-formed and cooled in the forming process, both a portion that has been so-called quenched corresponding to the region where the current density changing portion is established and a portion that has not been quenched are formed on the formed plate, i.e., the press-formed part (or that unfinished part).

As a result, the portion of the press-formed part to be strengthened is sufficiently heated in the heating process and quenched by cooling in the forming process. Portions that are to be welded or the like later or that are to be worked, e.g., bent or punched, are able to retain good characteristics for welding or working by either not being quenched as a result of being cooled in the forming process after not being sufficiently heated in the heating process, or being quenched to a lesser degree.

Moreover, the heating of the quenchable portion and the non-quenchable portion of the plate is controlled in the heating process prior to the forming process. Therefore, even if a complex cooling structure of the like for cooling only the predetermined region is not used in a die that is used in the forming process, the quenched portion and the non-quenched portion of the press-formed part can still be formed appropriately. As a result, the die cost and the like can be reduced.

As described above, the quenchable portion and the non-quenchable portion can be appropriately established in the plate in the heating process before the forming process where the press-forming and cooling take place. As a result, a complex die cooling structure is not necessary during forming so the die cost and the like can be reduced.

The heating process may be performed with a portion of the plate where the sectional area when the plate is cut in a direction orthogonal to the direction of current flow from the one end of the plate to the other end of the plate is different than the sectional area of another portion of the plate, serving as the current density changing portion.

The current density changing portion is established by making the sectional area at a portion of the plate, when the plate is cut in a direction orthogonal to the direction of current flow from one end to the other end of the plate, different from the sectional area at another portion of the plate. If the sectional area of the plate at the current density changing portion is smaller than the sectional area at the other portion of the plate, then when current is passed from one end to the other end of the plate in the heating process, the current density will basically become higher at the current density changing portion than it will at the other portion so the temperature at the current density changing portion will be higher than the temperature at the other portion. On the other hand, if the sectional area of the plate at the current density changing portion is larger than the sectional area at the other portion of the plate, then when current is passed from one end to the other end of the plate in the heating process, the current density will basically become lower at the current density changing portion than it will at the other portion so the temperature at the current density changing portion will be lower than the temperature at the other portion.

When the plate is press-formed and cooled in the forming-process after the heating process, the current density changing portion is quenched if the sectional area thereof is smaller than the sectional area of the other portion of the plate, and not quenched if the sectional area thereof is larger than the sectional area of the other portion of the plate. In this way, changing the shape of the plate such that the sectional area changes as described above in this way enables the current density changing portion to be easily established so that a quenchable portion and a non-quenchable portion can be incorporated into the plate before the forming portion.

The heating process may be performed with the current density changing portion established in a predetermined region of the plate in the direction of current flow by changing the width the plate orthogonal to both the direction of current flow from the one end of the plate to the other end of the plate and the thickness direction of the plate, in the direction of current flow.

The current density is increased by heating the plate by conduction in the heating process at a portion where the width of the plate narrows and an area near the corners formed on the plate by reducing the width of the plate. Accordingly, the temperature becomes higher there than it does at other portions. As a result, when the plate which has been through the heating process is press-formed and cooled in the forming process, the portion of the formed part where the current density is high in the plate is quenched and the portion where the current density is not high is not quenched. Therefore, the portion and the surrounding area of the formed part that is to be quenched can be made a quenchable portion in the heating process so that it can be quenched in the forming process, by shaping the plate so that the current density will become high at that portion before the plate reaches the forming process.

Changing the width of the plate in the direction of current flow makes it possible to ensure that a predetermined region of the plate in the direction of current flow is quenched and the rest of the plate is not quenched in the forming process after the heating process.

The heating process may be performed with the current density changing portion established in the plate by gradually reducing the width of the plate from one end side of the plate in the direction of current flow toward the other end side of the plate in the direction of current flow, such that the current density at the other end side is higher than the current density at the one end side.

In this case, when the plate is heated by conduction in the heating process, the heating temperature is lower at one end side of the plate in the direction of current flow and gradually increases toward the other end side. As a result, when the plate is press-formed and cooled in the forming process, the portion corresponding to the one end side of the plate of the formed part in the direction of current flow in the heating process is not quenched, or the region that is quenched can be reduced, and the portion corresponding to the other end side of the plate is quenched.

That is, the quenched region can be set.

The heating process may be performed with the current density changing portion established in the plate by forming a step in the width direction in the plate.

The current density changing portion is established in the plate by forming a step in the width direction of the plate in the plate. Therefore, when the plate is heated by conduction in the heating process, the current density increases near the corner of the plate at the portion where the step is formed, so the heating temperature at the area near this corner becomes locally high. As a result, when the plate is press-formed and cooled in the forming process, the area near the corner of the plate at the portion where the step is formed on the formed part can be locally quenched.

The heating process may be performed with the current density changing portion established in the plate by shaping an edge portion of the plate in the width direction that is toward the center portion with respect to both end sides of the plate in the direction of current flow so that the edge portion of the plate in the width direction is displaced toward the center of the plate in the width direction, such that the current density on the center portion side becomes higher than the current density on both end sides of the plate in the direction of current flow.

The edge portion in the width direction of the plate is bent or curved, for example, so that it is displaced toward the center portion side in the width direction, on the center portion side compared with both end sides of the plate in the direction of current flow. Therefore, a current density changing portion where the current density becomes higher on the edge portion side in the width direction that is bent or curved, as described above, and toward the center portion of the plate in the direction of current flow, is established in the plate.

Therefore, when the plate is heated by conduction in the heating process, the heating temperature is low on both end sides of the plate in the direction of current flow, and high on the center portion side of the plate in the direction of current flow (more specifically, on the center portion side of the plate in the direction of current flow and on the side of the edge portion in the width direction that is bent or curved as described above). As a result, when the plate is press-formed and cooled in the forming process, the portion of the formed part corresponding to both end sides of the plate in the direction of current flow is not quenched, or the region that is quenched can be reduced, and the portion of the formed part corresponding to the center portion side of the plate (more specifically, the portion corresponding to the center portion side of the plate in the direction of current flow and the side of the edge portion in the width direction that is bent or curved as described above) is quenched.

The heating process may be performed with the current density changing portion established in the plate by shaping an edge portion of the plate in the width direction that is toward the center portion with respect to both end sides of the plate in the direction of current flow so that the edge portion of the plate in the width direction is displaced toward the outside in the width direction of the plate, such that the current density on both end sides becomes higher than the current density on the center portion side of the plate in the direction of current flow.

The edge portion in the width direction of the plate is bent or curved, for example, so that it is displaced outward in the width direction on the center portion side compared with both end sides of the plate in the direction of current flow. Therefore, the current density changing portion where the current density is low on the center portion side in the direction of current flow of the plate and on the side of the edge portion in the width direction that is bent or curved as described above, is established in the plate.

Therefore, when the plate is heated by conduction in the heating process, the heating temperature is low on the center portion side of the plate in the direction of current flow (more specifically, on the center portion side of the plate in the direction of current flow and on the side of the edge portion in the width direction that is bent or curved as described above), and high on both end portion sides in the direction of current flow of the plate. As a result, when the plate is press-formed and cooled in the forming process, the portion of the formed part corresponding to the center portion side of the plate in the direction of current flow (more specifically, the portion corresponding to the center portion side of the plate in the direction of current flow and on the side of the edge portion in the width direction that is bent or curved as described above) is not quenched, or the region that is quenched can be reduced, and the portion of the formed part corresponding to the both end sides in the direction of current flow of the plate is quenched.

The heating process may be performed with the current density changing portion established in the plate by shaping the edge portions of the plate in the width direction so that the edge portions are displaced in the width direction in the direction of current flow, without changing the sectional area of the plate in the direction of current flow, when the plate is cut in a direction orthogonal to the direction of current flow from the one end of the plate to the other end of the plate.

The current density changing portion is established by shaping the plate such that the sectional area of the plate when it is cut in a direction orthogonal to the direction of current flow does not change, but the edge portions in the width direction of the plate change. As a result, the current density becomes higher on the side of the edge portion of the plate in the width direction that is displaced so as to curve inward in the width direction than it does on the side of the edge portion of the plate in the width direction that is displaced so as to bulge outward in the width direction.

Therefore, when the plate is heated by conduction in the heating process, the heating temperature of the plate is low on the side where the edge portion in the width direction bulges outward in the width direction, and is high on the side where the edge portion in the width direction curves inward in the width direction. As a result, when the plate is press-formed and cooled in the forming process, the portion of the formed part corresponding to the side where the edge portion of the plate bulges outward in the width direction is not quenched, or the region that is quenched can be reduced, and the portion of the formed part corresponding to the side where the edge portion of the plate in the width direction curves inward in the width direction is quenched.

The heating process may be performed with the current density changing portion established in the plate by making the thickness at one portion of the plate different from the thickness at another portion of the plate in the direction of current flow from the one end of the plate toward the other end of the plate.

The current density changing portion is established in the plate by making the thickness at one portion of the plate different than it is at another portion of the plate in the direction of current flow. Therefore, when the plate is heated by conduction in the heating process, the current density becomes higher at the portion where the plate is thinner than it does at the portion where the plate is thicker.

Therefore, the heating temperature of the plate can be locally increased by locally reducing the thickness of the plate and then heating the plate by conduction. Also, when the thickness of the plate is changed by gradually being reduced in the direction of current flow, the heating temperature of the plate can be gradually increased in the direction of current flow. As a result, when the plate is press-formed and cooled in the forming process, the portion of the formed part where the thickness of the plate has been reduced can be quenched.

Locally reducing the thickness of the plate enables the plate to be locally quenched in the forming process after the heating process. Also, gradually changing the thickness in the direction of current flow enables a predetermined region of the plate in the direction of current flow to be quenched in the forming process after the heating process.

The heating process may be performed with the density current changing portion established in the plate by forming a hole in the thickness direction through the plate.

A hole is formed in the plate, which reduces the sectional area of the plate at the portion where the hole is formed. Therefore, when the plate is heated by conduction in the heating process, the current density increases next to the hole in a direction orthogonal to both the thickness direction of the plate and the direction of current flow. As a result, the heating temperature of the plate increases at the portion beside the hole. Therefore, when the plate is press-formed and cooled in the forming process, only the portion of the formed part corresponding to the portion next to the hole and the portion near that portion is quenched.

A second aspect of the invention relates to a press-formed part i) which is formed by press-forming and cooling a plate which is connected to an electrode at one end in a direction orthogonal to the thickness direction and connected to another electrode at the other end in the direction orthogonal to the thickness direction and heated by passing current between the electrodes, and controlled to have a predetermined temperature distribution while the current is passing between the electrodes by establishing, at a predetermined portion between the electrodes, a portion where the current density is different than the current density at another portion, and ii) in which a portion where the current density is low is not quenched and a portion where the current density is high is quenched.

The plate used to form this press-formed part is connected to an electrode at one end in a direction orthogonal to the thickness direction and connected to another electrode at the other end in the direction orthogonal to the thickness direction, and then heated by passing current between the electrodes. Moreover, a portion where the current density is different than the current density at another portion is established at a predetermined portion of this plate between the electrodes. Therefore, when current is passing between the electrodes, the portion of the plate where the current density is high is heated to a high temperature, while the portion of the plate where the current density is low is not heated to a high temperature. In this way, the plate is heated with the desired temperature distribution, so a quenchable portion is formed at a desired portion of the plate and a non-quenchable portion is formed at another desired portion before press-forming.

Therefore, with the press-formed part that is formed by press-forming and cooling this kind of a plate, the desired portion is quenched, thereby improving the mechanical strength. Meanwhile, the other desired portion is not quenched, which makes it possible to take advantage of a portion that is not quenched, such as improved rust-proof performance when rust-proofing has been performed and improved weldability during welding. Moreover, the quenchable portion and the non-quenchable portion are incorporated into the plate before the plate is press-formed. As a result, a complex die cooling structure is not necessary during forming so the die cost and the like can be reduced.

BRIEF DESCRIPTION OF THE DRAWINGS

The foregoing and further objects, features and advantages of the invention will become apparent from the following description of exemplary embodiments with reference to the accompanying drawings, wherein like numerals are used to represent like elements and wherein.

DETAILED DESCRIPTION OF EMBODIMENTS

Figure 1:
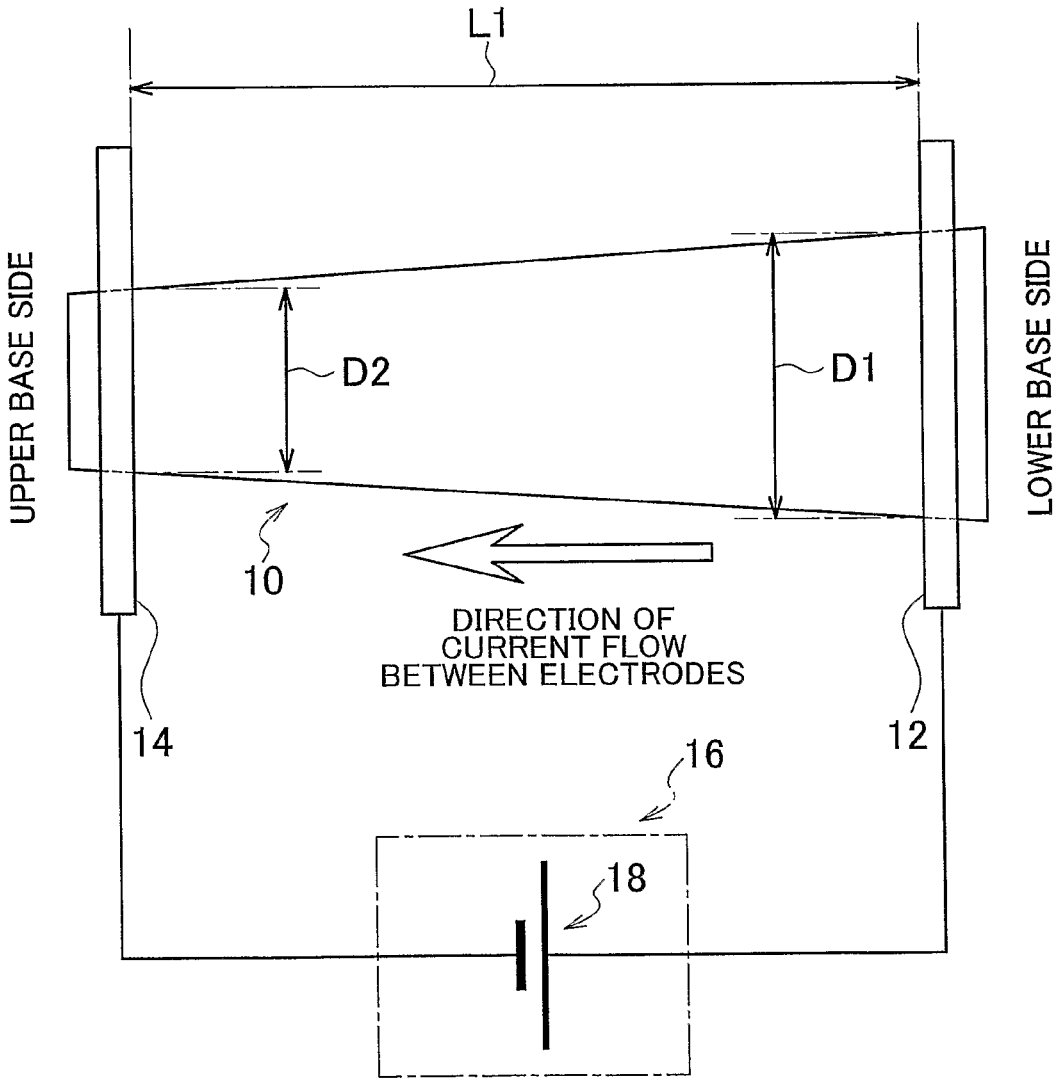
FIG. 1 is a view schematically showing a heating process in a press-forming method according to a first example embodiment of the invention.

FIG. 1 is a view schematically showing a heating process in a press-forming method according to a first example embodiment of the invention. In the press-forming method according to this example embodiment, a flat metal plate 10 which serves as the plate in a heating process which will be described later is press-formed in a forming process after being heated by conduction. As shown in FIG. 1, when viewed from above, the flat metal plate 10 has a trapezoidal shape and is of uniform thickness, and the upper base side is parallel with the lower base side. Moreover, the lower base side is longer than the upper base side, and a line that connects the center of the upper base side with the center of the lower base side is orthogonal to both the upper and lower base sides.

An electrode 12 is connected to the lower base side of the flat metal plate 10, and an electrode 14 is connected to the upper base side of the flat metal plate 10. The electrode 12 is connected to a positive terminal of a power supply 18 of a quenching apparatus 16, and the electrode 14 is connected to a negative terminal of the power supply 18 of the quenching apparatus 16. Therefore, in the press-forming method according to this example embodiment, current flows from the lower base side toward the upper base side of the flat metal plate 10 which is trapezoidal when viewed from above.

Next, the operation and effects of this example embodiment will be described through a description of the processes in the press-forming method according to this example embodiment.

In the press-forming method according to this example embodiment, the flat metal plate 10 is heated by conduction in a heating process. As shown in FIG. 1, in the heating process the flat metal plate 10 is heated by the electrical resistance of the flat metal plate 10 when current is made to flow from the electrode 12 toward the electrode 14 through the flat metal plate 10 while the flat metal plate 10 is connected to the electrodes 12 and 14. Here, even though the thickness of the flat metal plate 10 is uniform, the flat metal plate 10 has a trapezoidal shape in which the lower base side is longer than the upper base side when viewed from above. Therefore, the sectional area of the flat metal plate 10 when the flat metal plate 10 is cut in a direction orthogonal to the direction in which current flows between the electrodes 12 and 14 is smaller on the electrode 14 side than it is on the electrode 12 side. Accordingly, the current density of the current flowing through the flat metal plate 10 is greater on the electrode 14 side than it is on the electrode 12 side. As a result, when current flows through the flat metal plate 10, the temperature of the flat metal plate 10 becomes higher on the electrode 14 side than it does on the electrode 12 side.

Figure 2A:
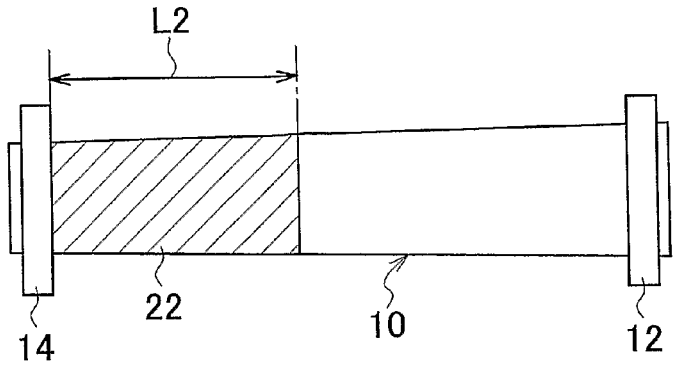
FIGS. 2A to 2C are plan views schematically showing the distribution of a quenchable range of a plate by the press-forming method according to the first example embodiment of the invention.
Figure 2B:
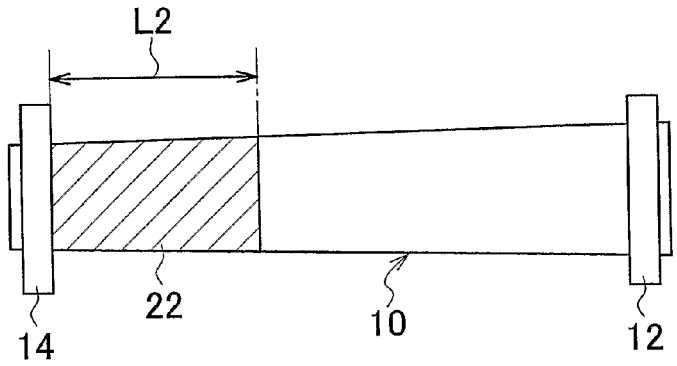
Figure 2C:
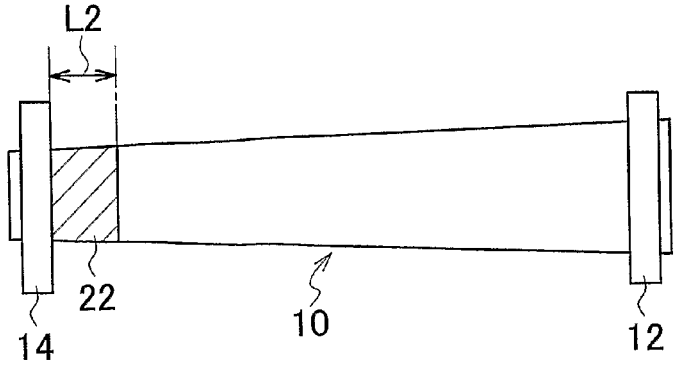

Here, FIGS. 2A to 2C show the temperature distribution when a steel sheet to be quenched that is 1.2 mm thick is used as the flat metal plate 10. With the flat metal plates 10 shown in FIGS. 2A to 2C, the distance L1 between the electrodes 12 and 14 in FIG. 1 is set to 600 mm and the width D1 of the flat metal plate 10 at the portion where the electrode 12 is connected (i.e., the dimension that is parallel with the lower base side) is set to 120 mm. Also, the width D2 of the flat metal plate 10 at the portion where the electrode 14 is connected (i.e., the dimension that is parallel with the upper base side) is set to 108 mm in FIG. 2A, 102 mm in FIG. 2B, and 84 mm in FIG. 2C.

In this example embodiment, as described above, the width of the flat metal plate 10 gradually decreases in the direction in which the current flows through the flat metal plate 10, i.e., in the direction from the electrode 12 to the electrode 14, so the current density gradually increases in the direction from the electrode 12 to the electrode 14. In particular, when the portion where the current density increases to the point at which the flat metal plate 10 can be heated to between 850° C. and 950° C. is designated a current density changing portion 22 in this example embodiment, the hatched portion in FIGS. 2A to 2C is that current density changing portion 22.

Here, in the example shown in FIG. 2A, the width D2 of the flat metal plate 10 at the portion where the electrode 14 is connected is 10% shorter than the width D1 of the flat metal plate 10 at the portion where the electrode 12 is connected. Therefore, the sectional area of the flat metal plate 10 which the flat metal plate 10 is cut in a direction orthogonal to the direction from the electrode 12 to the electrode 14 is 10% less at the portion where the electrode 14 is connected than it is at the portion where the electrode 12 is connected. Meanwhile, in the example shown in FIG. 2A, the current density changing portion 22 is formed extending 26 mm from the portion where the electrode 14 is connected toward the side where the electrode 12 is connected (i.e., in the region indicated by arrow L2 in FIG. 2A). That is, with a structure in which the sectional area of the flat metal plate 10 is 10% less at the portion where the electrode 14 is connected than it is at the portion where the electrode 12 is connected, approximately 40% of the region from the portion where the electrode 14 is connected to the portion where the electrode 12 is connected is able to be heated to a quenchable temperature at an area ratio of the flat metal plate 10 at the electrode 12 and at the electrode 14.

In contrast, in the example shown in FIG. 2B, the width D2 of the flat metal plate 10 at the portion where the electrode 14 is connected is 15% shorter than the width D1 of the flat metal plate 10 at the portion where the electrode 12 is connected. Therefore, the sectional area of the flat metal plate 10 when the flat metal plate 10 is cut in a direction orthogonal to the direction from the electrode 12 to the electrode 14 is 15% less at the portion where the electrode 14 is connected than it is at the portion where the electrode 12 is connected. Meanwhile, in the example shown in FIG. 2B, the current density changing portion 22 is formed extending 194 mm from the portion where the electrode 14 is connected toward the side where the electrode 12 is connected (i.e., in the region indicated by arrow L2 in FIG. 2B). That is, with a structure in which the sectional area of the flat metal plate 10 is 15% less at the portion where the electrode 14 is connected than it is at the portion where the electrode 12 is connected, approximately 30% of the region from the portion where the electrode 14 is connected to the portion where the electrode 12 is connected is able to be heated to a quenchable temperature at an area ratio of the flat metal plate 10 between the electrodes 12 and 14.

Also, In contrast, in the example shown in FIG. 2C, the width D2 of the flat metal plate 10 at the portion where the electrode 14 is connected is 30% shorter than the width D1 of the flat metal plate 10 at the portion where the electrode 12 is connected. Therefore, the sectional area of the flat metal plate 10 when the flat metal plate 10 is cut in a direction orthogonal to the direction from the electrode 12 to the electrode 14 is 30% less at the portion where the electrode 14 is connected than it is at the portion where the electrode 12 is connected. Meanwhile, in the example shown in FIG. 2C, the current density changing portion 22 is formed extending 66 mm from the portion where the electrode 14 is connected toward the side where the electrode 12 is connected (i.e., in the region indicated by arrow L2 in FIG. 2C). That is, with a structure in which the sectional area of the flat metal plate 10 is 30% less at the portion where the electrode 14 is connected than it is at the portion where the electrode 12 is connected; approximately 10% of the region from the portion where the electrode 14 is connected to the portion where the electrode 12 is connected is able to be heated to a quenchable temperature at an area ratio of the flat metal plate 10 between the electrodes 12 and 14.

In this way, with the flat metal plate 10 having a trapezoidal shape when viewed from above, the current density changing portion 22 is formed on the upper base side with respect to the center portion of the flat metal plate 10 in the direction in which current flows when current flows from the lower base side toward the upper base side of the flat metal plate 10 in the heating process. As a result, a quenchable portion is formed on the upper base side with respect to the center portion of the flat metal plate 10 in the direction in which current flows, and a non-quenchable portion is formed on the lower base side with respect to the center portion of the flat metal plate 10 in the direction in which current flows.

Figure 3:
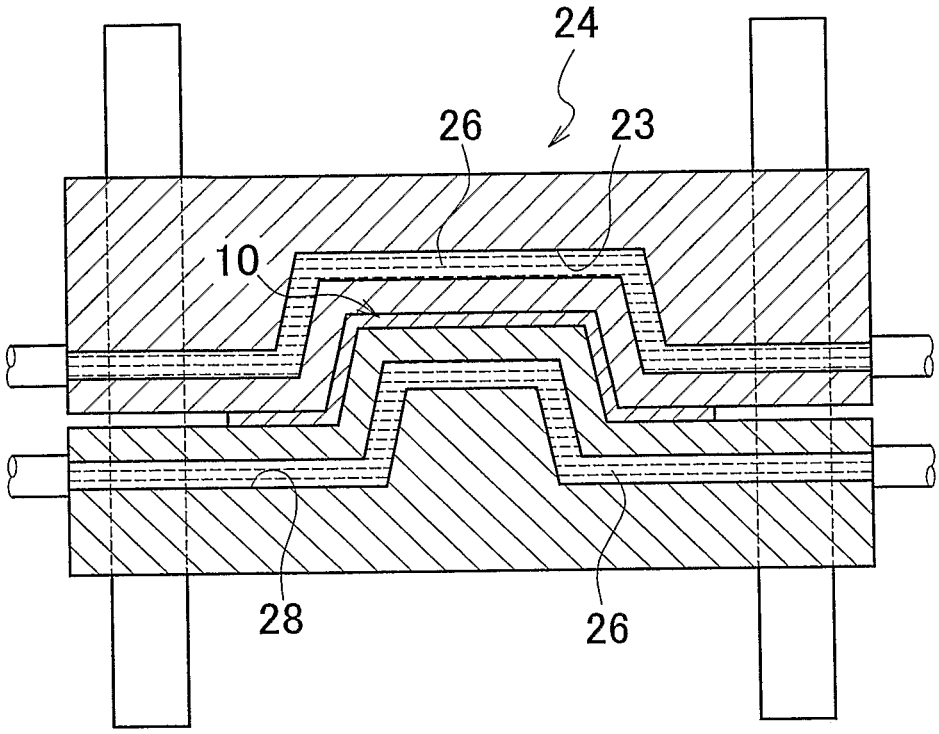
FIG. 3 is a view schematically showing a forming process in the press-forming method according to the first example embodiment of the invention.

The flat metal plate 10 that has been heated by conduction as described above in the heating process is then press-formed into a predetermined shape in a forming process. In this forming process, the heated flat metal plate 10 is set into a die 24 as shown in FIG. 3. A flow path 28 through which coolant 26 such as cooling water flows is formed in the die 24. When the flat metal plate 10 that has been heated by conduction is pressed by the die 24, the flat metal plate 10 is formed into a predetermined shape and rapidly cooled (i.e., cooled) by the die 24 which is cooled by the coolant 26. The quenchable portion that is on the upper base side with respect to the center portion of the flat metal plate 10 is quenched by rapidly cooling the flat metal plate 10 with the die 24.

In this way, with the press-forming method according to this example embodiment, forming the flat metal plate 10 in a trapezoidal shape when viewed from above enables the quenchable region from the upper base side of the flat metal plate 10 to be set by the ratio of the widths of the flat metal plate 10 at the upper and lower base sides of the trapezoid when heating the flat, metal plate 10 by conduction in the heating process. Therefore, applying this example embodiment makes it possible to easily manufacture a press-formed part in which only a predetermined region to one side of the center portion in a direction orthogonal to the thickness direction of the flat metal plate 10 in the state shown in FIG. 3 is quenched, while the other side is not quenched.

Moreover, the flat metal plate 10 which has been heated by conduction in the heating process is press-formed in the forming process so the structure of the die 24, and more particularly, the cooling structure of the die 24, does not have to be complex, which enables the cost of the die and the like to be reduced.

Next, other example embodiments of the invention will be described. In the descriptions of these example embodiments, portions that are basically the same as portions in the first example embodiment described above will be denoted by the same reference characters and descriptions of those portions will be omitted. Also, in the second to the eighth example embodiments described below, the forming process is basically the same as it is in the first example embodiment described above so the description relating to the forming process will be omitted in the descriptions of the second to the eighth example embodiments.

Figure 4:
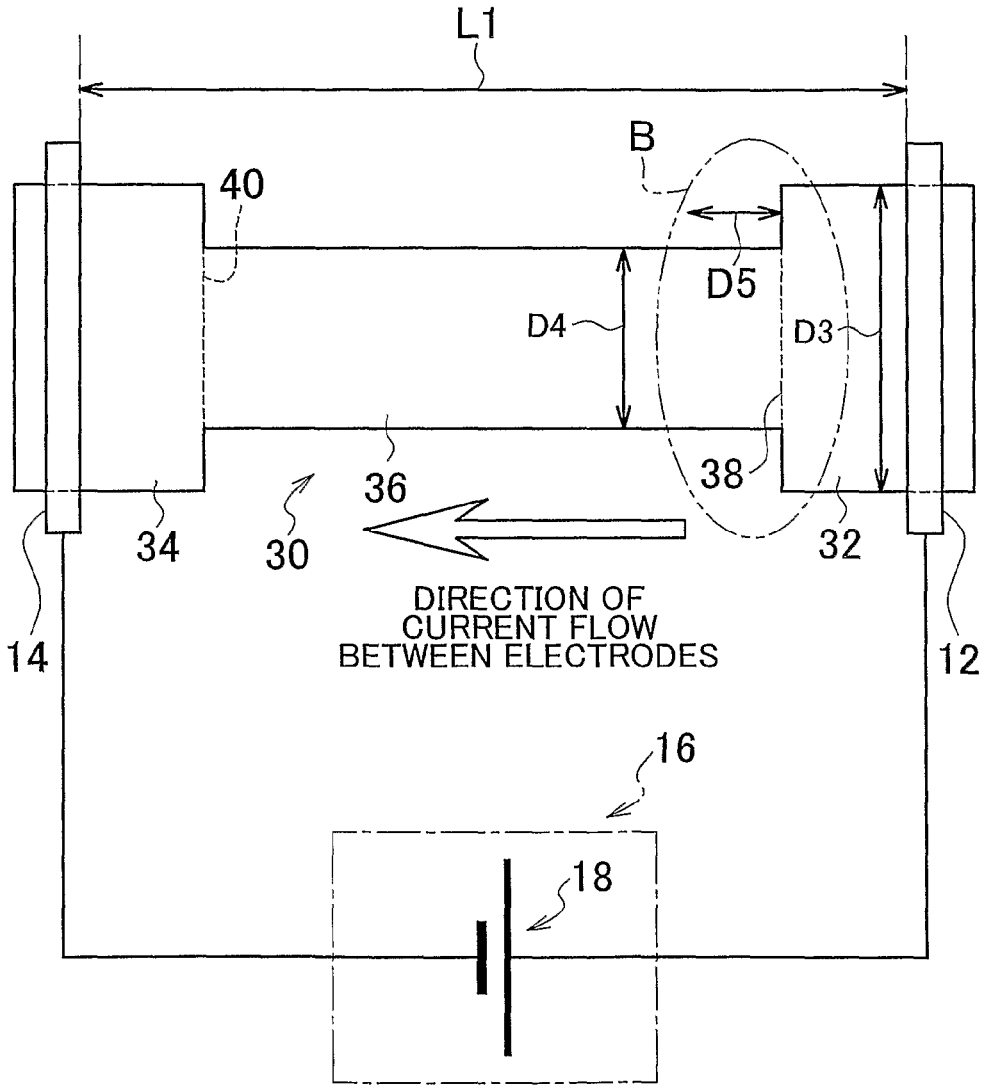
FIG. 4 is a view schematically showing a heating process in a press-forming method according to a second example embodiment of the invention.

FIG. 4 is a view schematically showing a heating process in a press-forming method according to a second example embodiment of the invention. In this example embodiment, a flat metal plate 30 which serves as the plate is heated by conduction. As shown in FIG. 4, the flat metal plate 30 has a pair of wide portions 32 and 34. The wide portion 32 has a uniform thickness and is formed in a rectangular shape when viewed from above. In contrast, the wide portion 34 is formed in generally the same shape as the wide portion 32. A narrow portion 36 is formed between the wide portion 32 and the wide portion 34. This narrow portion 36 has the same thickness as the wide portions 32 and 34 and is formed in a rectangular shape when viewed from above.

However, the dimension D4 of the narrow portion 36 in the width direction of the flat metal plate 30 is set smaller than the dimension D3 of the wide portions 32 and 34 in the same direction. The end of the narrow portion 36 on the wide portion 32 side is connected to the end of the wide portion 32 on the narrow portion 36 side with the center of the end of the wide portion 32 in the width direction of the flat metal plate 30 substantially aligned with the center of the end of the narrow portion 36 in the width direction of the flat metal plate 30. Also, the end of the narrow portion 36 on the wide portion 34 side is connected to the end of the wide portion 34 on the narrow portion 36 side with the center of the end of the wide portion 34 in the width direction of the flat metal plate 30 substantially aligned with the center of the end of the narrow portion 36 in the width direction of the flat metal plate 30.

In this way, the electrode 12 is connected to the wide portion 32 of the flat metal plate 30, which is formed by the wide portions 32 and 34 and the narrow portion 36, and the electrode 14 is connected to the wide portion 34. Therefore, current flows from the wide portion 32 to the wide portion 34 through the narrow portion 36. Also, the boundary between the wide portion 32 and the narrow portion 36 of the flat metal plate 30 is designated as a current density changing portion 38, and the boundary between the wide portion 34 and the narrow portion 36 is designated as a current density changing portion 40. When the flat metal plate 30 is cut in the direction orthogonal to the direction in which current flows between the electrodes 12 and 14, the sectional area suddenly changes at the current density changing portions 38 and 40.

The electrodes 12 and 14 are connected to the flat metal plate 30 structured as described above and that flat metal plate 30 is then heated by conduction in a heating process. In this state, the flat metal plate 30 is heated by the electrical resistance of the flat metal plate 30 when current is made to flow from the electrode 12 toward the electrode 14 through the flat metal plate 30. Here, even though the thickness of the flat metal plate 30 is uniform, the narrow portion 36 positioned in the center portion of the flat metal plate 30 in the direction in which the current flows is narrower in the width direction of the flat metal plate 30 than the wide portion 32 where the electrode 12 is connected and the wide portion 34 where the electrode 14 is connected. Therefore, the sectional area of the narrow portion 36 cut in the direction orthogonal to the direction in which current flows is smaller than the sectional areas of the wide portions 32 and 34. Accordingly, the current density is higher at the narrow portion 36 than it is at the wide portions 32 and 34 so the temperature increases at the narrow portion 36 of the flat metal plate 30.

Moreover, the narrow portion 36 is connected to the wide portions 32 and 34 such that the center of the narrow portion 36 in the width direction of the flat metal plate 30 is substantially aligned with the centers of the wide portions 32 and 34 in the width direction of the flat metal plate 30. As a result, steps in the width direction of the flat metal plate 30 are formed at both ends in the width direction of the flat metal plate 30 at the current density changing portion 38 which is the boundary between the narrow portion 36 and the wide portion 32, and at the current density changing portion 40 which is the boundary between the narrow portion 36 and the wide portion 34. Accordingly, when current flows between the electrodes 12 and 14, the current density becomes particularly high on both end sides in the width direction of the flat metal plate 30 at the current density changing portions 38 and 40. As a result, the temperature becomes particularly high near the outside edge of each of the four corners of the narrow portion 36 in the width direction of the flat metal plate 30.

Figure 5A:
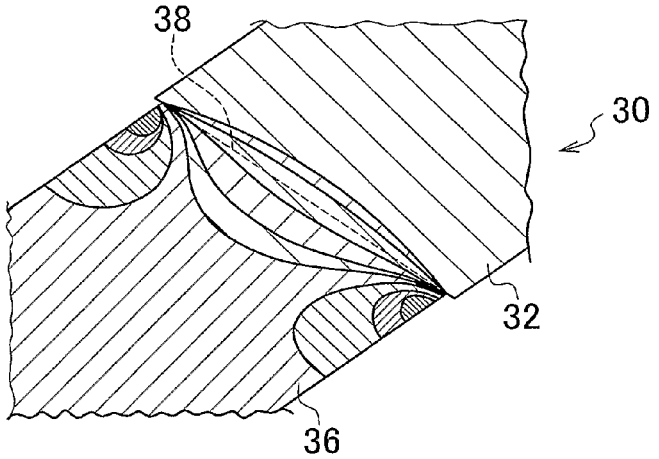
FIGS. 5A to 5C are partial enlarged perspective views showing the temperature distribution (i.e., the distribution over the quenchable region) of the plate by the press-forming method according to the second example embodiment of the invention.
Figure 5B:
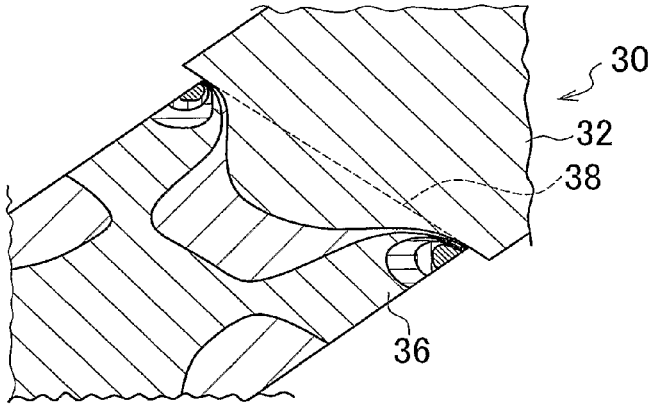
Figure 5C:
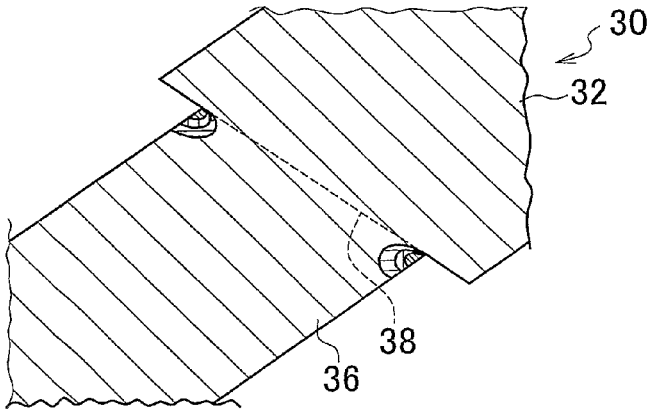

FIGS. 5A to 5C are enlarged perspective views showing the temperature distribution of the flat metal plate 30, which has been heated by flowing current between the electrodes 12 and 14, at the portion outlined by the oval B shown by the alternate long and two short dashes line in FIG. 4 as well as the area therearound.

In FIGS. 5A to 5C, the hatching indicates the temperature distribution, not the cross-section. Regions having hatching of the same width and in the same direction are regions of substantially the same temperature. Also, narrower hatching indicates a higher temperature. The temperature of the region with the widest hatching is a non-quenchable temperature and is less than approximately 850° C.

A steel sheet to be quenched that is 1.2 mm thick is used for each flat metal plate 30 shown in FIGS. 5A to 5C. The width of the wide portions 32 and 34 in the width direction of the flat metal plate 30 (i.e., diameter D3 in the width direction of the flat metal plate 30 in FIG. 4) is set to 120 mm. Also, with the flat metal plate 30 shown in FIG. 5A, the width D4 of the narrow portion 36 in the width direction of the flat metal plate 30 in FIG. 4 is set to 114 mm. The width D4 of the narrow portion 36 of the flat metal plate 30 shown in FIG. 5B is set to 102 mm, and the width D4 of the narrow portion 36 of the flat metal plate 30 shown in FIG. 5C is set to 84 mm.

With the flat metal plate 30 shown in FIG. 5A, the sectional area of the flat metal plate 30 when the flat metal plate 30 is cut in a direction orthogonal to the direction of current flow is 5% less at the narrow portion 36 than it is at the wide portions 32 and 34, at the current density changing portions 38 and 40. Even though the temperature of the flat metal plate 30 increases near the outside edge of each of the four corners of the narrow portion 36 in the width direction of the flat metal plate 30, the change in the sectional area is small at 5%. As a result, the narrow portion 36 is heated until an entire predetermined region (e.g., a region the length of the difference D5 between width D3 and width D4 from the end of the narrow portion 36 on the wide portion 32 side) from the end of the narrow portion 36 on the wide portion 32 side toward the center of the narrow portion 36 in the width direction of the flat metal plate 30, and an entire predetermined region (e.g., a region the length of the difference D5 between width D3 and width D4 from the end of the narrow portion 36 on the wide portion 34 side) from the end of the narrow portion 36 on the wide portion 34 side toward the center of the narrow portion 36 in the width direction of the flat metal plate 30, reaches a quenchable temperature (i.e., between 850° C. and 950° C.).

In contrast, with the flat metal plate 30 shown in FIG. 5B, the sectional area of the flat metal plate 30 cut in a direction orthogonal to the direction of current flow is 15% less at the narrow portion 36 than it is at the wide portions 32 and 34, at the current density changing portions 38 and 40. With this flat metal plate 30, the temperature increases near the outside edge of each of the four corners of the narrow portion 36 in the width direction of the flat metal plate 30, and the temperature of the narrow portion 36 decreases toward the center of the narrow portion 36 in both the direction of current flow and the width direction of the flat metal plate 30. In this flat metal plate 30, the region that has been heated to a quenchable temperature in a region with an area the same as that of the predetermined region from the end of the narrow portion 36 on the wide portion 32 side as well as from the end of the narrow portion 36 on the wide portion 34 side (e.g., a region the length of the difference D5 between width D3 and width D4 from the end of the narrow portion 36 on the wide portion 32 side as well as from the end of the narrow portion 36 on the wide portion 34 side) is approximately 32% of the narrow portion 36.

Furthermore, with the flat metal plate 30 shown in FIG. 5C, the sectional area of the flat metal plate 30 cut in a direction orthogonal to the direction of current flow is 30% less at the narrow portion 36 than it is at the wide portions 32 and 34, at the current density changing portions 38 and 40. The temperature distribution is even more remarkable due to the decrease in the sectional area of the narrow portion 36 with respect to wide portions 32 and 34 in this way. Thus, with this flat metal plate 30 only the area near the outside edge of each of the four corners of the narrow portion 36 in the width direction of the flat metal plate 30 is heated, so the region that has been heated to a quenchable temperature in a region with the area the same as that of the predetermined region described above (e.g., a region that extends a length equal to the difference D5 between width D3 and width D4 from the end of the narrow portion 36 on the wide portion 32 side and from the end of the narrow portion 36 on the wide portion 34 side) is approximately 4.6% of the narrow portion 36.

In this way, with the press-forming method according to this example embodiment, forming the narrow portion 36 in the center of the flat metal plate 30 in the direction in which current flows when the flat metal plate 30 is heated by conduction in the heating process creates the current density changing portions 38 and 40 at the boundaries between the narrow portion 36 and the wide portions 32 and 34, respectively, during the heating process. As a result, quenchable portions can be established at and around the four corners of the narrow portion 36. Moreover, the regions of the quenchable portions at and around the four corners of the narrow portion 36 can be set by the ratio of the widths of the wide portions 32 and 34 in the width direction of the flat metal plate 30 to the width of the narrow portion 36 in the width direction of the flat metal plate 30. As a result, a press-formed part in which portions corresponding to predetermined regions at and around the four corners of the flat metal plate 30 have been quenched by press-forming and rapidly cooling the flat metal plate 30 in the forming process can easily be manufactured.

Moreover, the flat metal plate 30 that has been heated by conduction in the heating process is press-formed in the forming process so the structure of the die 24, and more particularly, the cooling structure of the die 24, does not have to be complex, which enables the cost of the die and the like to be reduced.

Next, a third example embodiment of the invention will be described.

Figure 6:
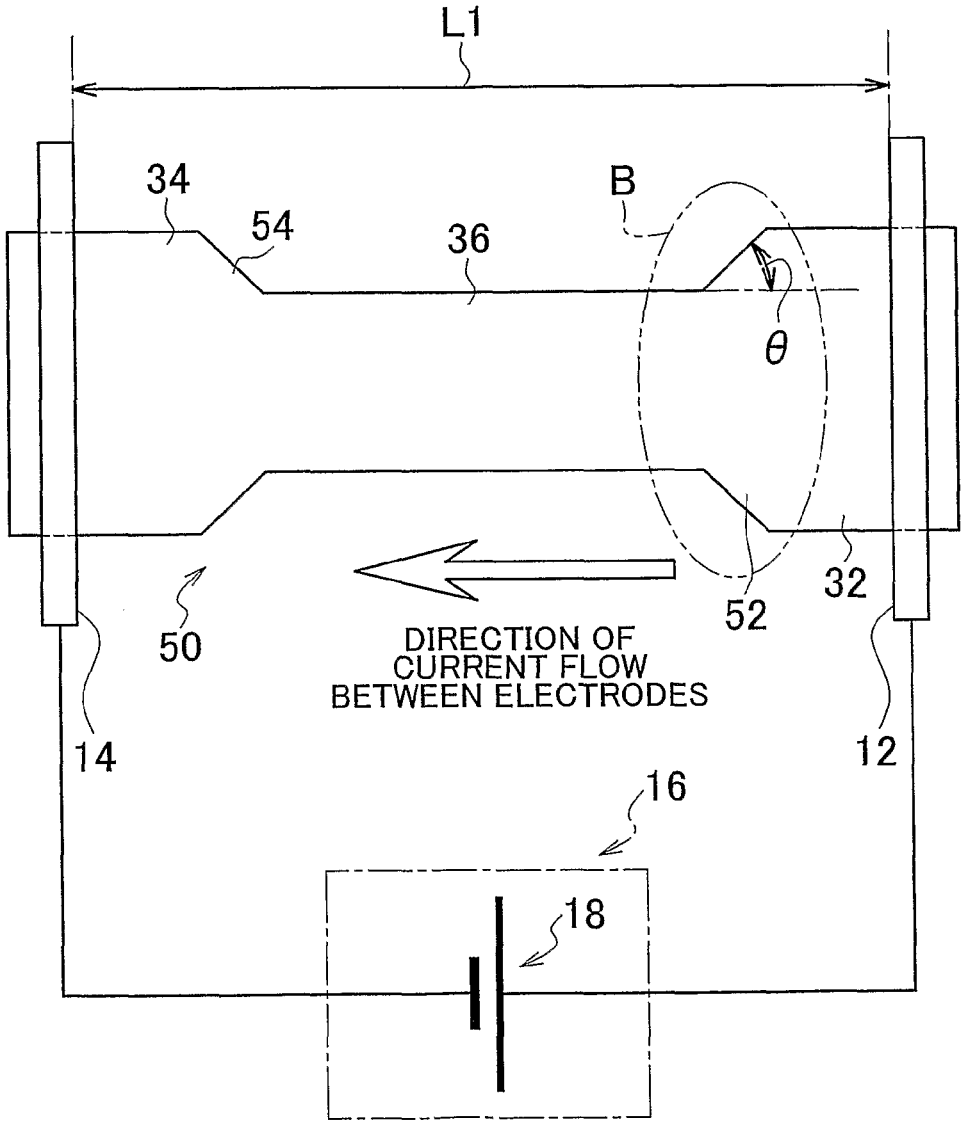
FIG. 6 is a view schematically showing a heating process in a press-forming method according to a third example embodiment of the invention.

FIG. 6 is a view schematically showing a heating process in a press-forming method according to the third example embodiment of the invention. In this example embodiment, a flat metal plate 50 which serves as the plate is heat treated. As shown in FIG. 6, the flat metal plate 50 has a trapezoidal portion 52 formed as a current density changing portion between the wide portion 32 and the narrow portion 36. The side of the trapezoidal portion 52 that is near the wide portion 36 is parallel to the side of the trapezoidal portion 52 that is near the wide portion 32. The distance between the edges on both sides of the trapezoidal portion 52 in the width direction of the flat metal plate 50 gradually becomes shorter from the side of the wide portion 32 toward the side of the narrow portion 36.

Meanwhile, the flat metal plate 50 also has a trapezoidal portion 54 formed as a current density changing portion between the wide portion 34 and the narrow portion 36. The side of the trapezoidal portion 54 that is near the narrow portion 36 is parallel to the side of the trapezoidal portion 54 that is near the wide portion 34. The distance between the edges on both sides of the trapezoidal, portion 54 in the width direction of the flat metal plate 50 gradually becomes shorter from the side of the wide portion 34 toward the side of the narrow portion 36.

That is, in contrast to the flat metal plate 30 in the second example embodiment described above, in which the boundaries between the narrow portion 36 and the wide portions 32 and 34 are the current density changing portions 38 and 40, respectively, in this example embodiment the current density changing portions of the flat metal plate 50 (i.e., the trapezoidal portions 52 and 54) become wider farther away from the narrow portion 36. That is, in contrast to the flat metal plate 30, when the flat metal plate 50 is cut in a direction orthogonal to the direction of current flow, the sectional areas of the trapezoidal portions 52 and 54 gradually decrease from the side near the wide portions 32 and 34 toward the side near the narrow portion 36.

The electrodes 12 and 14 are connected to the flat metal plate 50 structured as described above and that flat metal plate 50 is then heated by conduction in a heating process. In this state, the sectional area of the flat metal plate 50 when the flat metal plate 50 is cut in a direction orthogonal to the direction of current flow is less at the narrow portion 36 than it is at the wide portions 32 and 34, just as it is with the flat metal plate 30 in the second example embodiment described above. Therefore, the current density is higher at the narrow portion 36 than it is at the wide portions 32 and 34, so the temperature of the flat metal plate 50 becomes higher at the narrow portion 36.

In addition, the dimensions of the trapezoidal portions 52 and 54 gradually become smaller toward the narrow portion 36 side. With this kind of structure, the temperature becomes higher particularly near both ends of the narrow portion 36 in the direction of current flow and near both ends of the narrow portion 36 in the width direction of the flat metal plate 50, just as with the flat metal plate 30 in the second example embodiment described above.

Figure 7A:
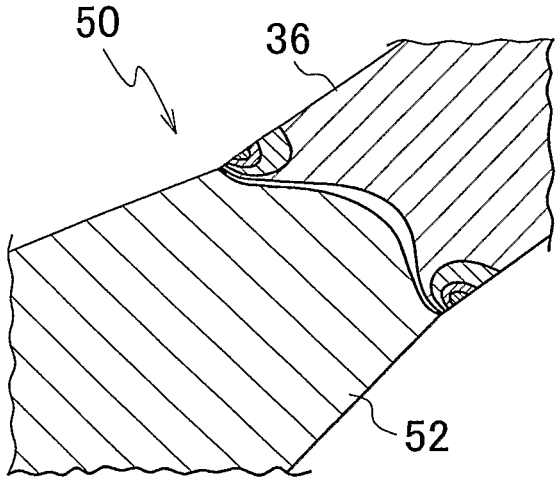
FIGS. 7A to 7C are partial enlarged perspective views showing the temperature distribution (i.e., the distribution over the quenchable region) of the plate by the press-forming method according to the third example embodiment of the invention.
Figure 7B:
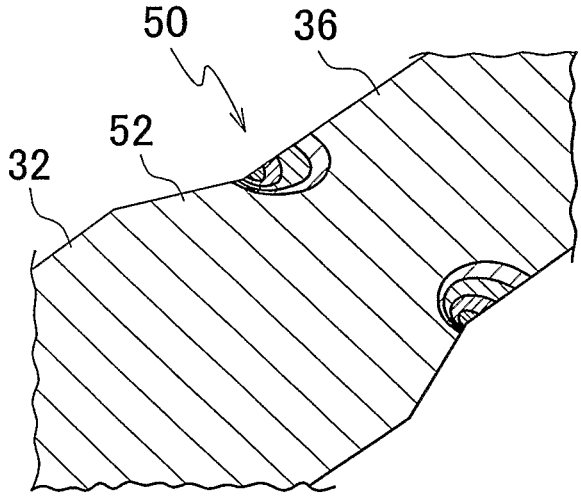
Figure 7C:
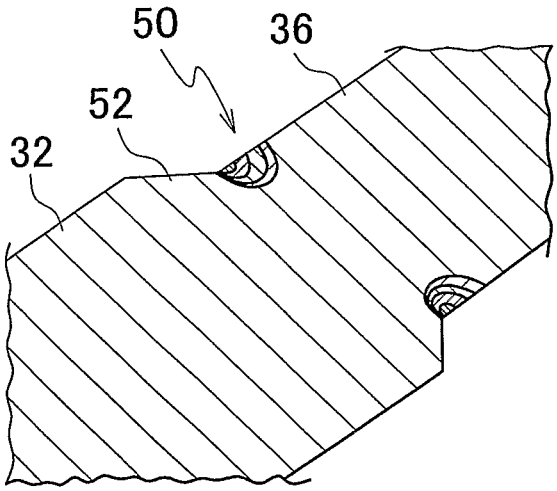

FIGS. 7A to 7C are enlarged perspective views showing the temperature distribution of the flat metal plate 50, which has been heated by flowing current between the electrodes 12 and 14, at the portion outlined by the oval B shown by the alternate long and two short dashes line in FIG. 6 as well as the area therearound.

In FIGS. 7A to 7C, the hatching indicates the temperature distribution, not the cross-section. Regions having hatching of the same width and in the same direction are regions of substantially the same temperature. Also, narrower hatching indicates a higher temperature. The temperature of the region with the widest hatching is a non-quenchable temperature and is less than approximately 850° C.

A steel sheet to be quenched that is 1.2 mm thick is used for each flat metal plate 50 shown in FIGS. 7A to 7C. The width of the wide portions 32 and 34 in the width direction of the flat metal plate 50 is set to 120 mm, and the width of the narrow portion 36 in the width direction of the flat metal plate 50 is set to 84 mm.

Furthermore, with the flat metal plates 50 shown in FIGS. 7A to 7C, the inclination angle θ of both ends of the trapezoidal portions 52 and 54 in the width direction of the flat metal plate 50 in FIG. 6 is different. As a result, the dimensions of the trapezoidal portions 52 and 54 in the length direction of the flat metal plate 50 are different.

That is, with the flat metal plate 50 shown in FIG. 7A, the inclination angle θ is set to 15 degrees, so the width of the trapezoidal portions 52 and 54 in the length direction of the flat metal plate 50 is 67 mm. Also, with the flat metal plate 50 shown in FIG. 7B, the inclination angle θ is set to 30 degrees, so the width of the trapezoidal portions 52 and 54 in the length direction of the flat metal plate 50 is 31 mm. Further, with the flat metal plate 50 shown in FIG. 7C, the inclination angle θ is set to 45 degrees, so the width of the trapezoidal portions 52 and 54 in the length direction of the flat metal plate 50 is 18 mm. Although not shown in FIGS. 7A to 7C, a structure in which the inclination angle of the trapezoidal portions 52 and 54 are set to 90 degrees is the same as the structure shown in FIG. 5C.

As described in the foregoing second example embodiment, with the structure shown in FIG. 5C, the sectional area of the flat metal plate 30 cut in the direction orthogonal to the direction of current flow is 30% less than at the narrow portion 36 than it is at the wide portions 32 and 34, at the current density changing portions 38 and 40. Therefore, only the area near the outside edge of each of the four corners of the narrow portion 36 in the width direction of the flat metal plate 30 is heated, so the region that has been heated to a quenchable temperature in a region that extends a length equal to the difference D5 between width D3 and width D4 from the end of the narrow portion 36 on the wide portion 32 side and from the end of the narrow portion 36 on the wide portion 34 side is approximately 4.6%.

In contrast, with the flat metal plate 50 shown in FIG. 7C, the change rate of the sectional area of the narrow portion 36 with respect to the sectional area of the wide portions 32 and 34 cut in the direction orthogonal to the direction of current flow is the same as it is with the structure shown in FIG. 5C. However, the trapezoidal portions 52 ad 54 which are the current density changing portions are interposed between the narrow portion 36 and the wide portions 32 and 34 so the change in the sectional area from the wide portions 32 and 34 to the narrow portion 36 is gradual compared with the structure shown in FIG. 5C.

Therefore, with the flat metal plate 50 shown in FIG. 7C as well, only the area near the outside edge of each of the four corners of the narrow portion 36 in the width direction of the flat metal plate 50 is heated, so the region that has been heated to a quenchable temperature in a region that extends a length equal to the difference D5 between width D3 and width D4 in FIG. 4 from the end of the narrow portion 36 on the wide portion 32 side and from the end of the narrow portion 36 on the wide portion 34 side is wider at approximately 8.2%.

Also, with the flat metal plate 50 shown in FIG. 7B, the change in the sectional area from the wide portions 32 and 34 to the narrow portion 36 is even more gradual so the region that has been heated to a quenchable temperature in a region that extends a length equal to the difference D5 between width D3 and width D4 in FIG. 4 is even wider at approximately 16% of the narrow portion 36. Further, with the flat metal plate 50 shown in FIG. 7C, the change in the sectional area from the wide portions 32 and 34 to the narrow portion 36 is even more gradual so the region that has been heated to a quenchable temperature in a region that extends a length equal to the difference D5 between width D3 and width D4 in FIG. 4 is even still wider at approximately 38%.

In this way, with the press-forming method according to this example embodiment, when the flat metal plate 50 is heated by conduction in the heating process, the quenchable region at and around the four corners of the narrow portion 36 can be set by appropriately setting the inclination angle θ of the end portions in the width direction of the trapezoidal portions 52 and 54, even without changing the ratio of the sectional area of the narrow portion 36 to the sectional area of the wide portions 32 and 34. Therefore, the portions corresponding to the four corners and therearound of the narrow portion 36 of the flat metal plate 50 can be quenched by press-forming and rapidly cooling the flat metal plate 50 in the forming process. As a result, a press-formed part in which portions corresponding to the areas at and around the four corners of the flat metal plate 50 which is generally rectangular when viewed from above are quenched can be easily manufactured.

Moreover, the flat metal plate 50 which has been heated by conduction in the heating process is press-formed in the forming process so the structure of the die 24, and more particularly, the cooling structure of the die 24, does not have to be complex, which enables the cost of the die and the like to be reduced.

Next, a fourth example embodiment of the invention will be described.

Figure 8:
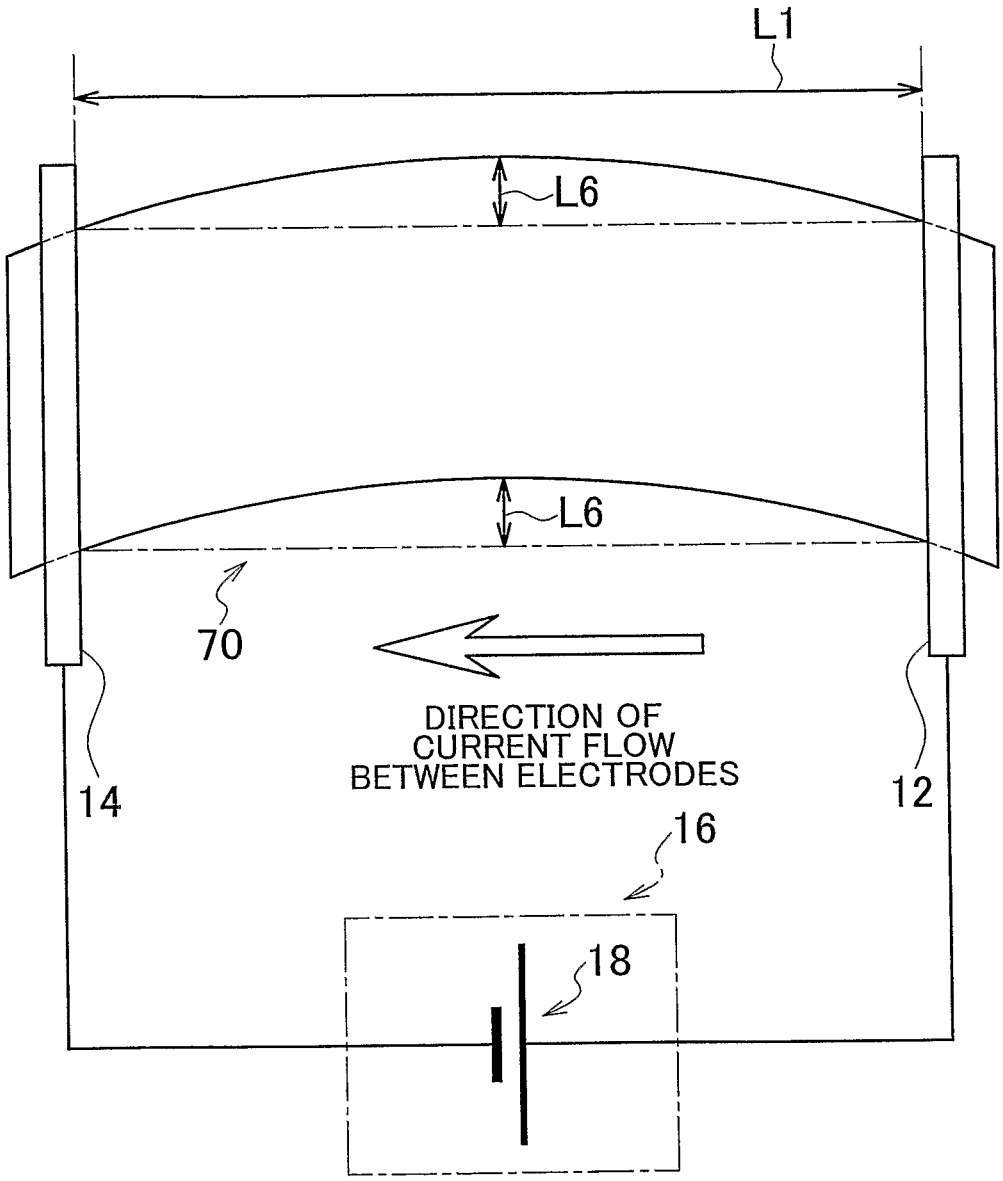
FIG. 8 is a view schematically showing a heating process in a press-forming method according to a fourth example embodiment of the invention.

FIG. 8 is a view schematically showing a heating process in a press-forming method according to the fourth example embodiment of the invention. In this example embodiment, a flat metal plate 70 which serves as the plate is heat treated. As shown in FIG. 8, the electrode 12 is attached near one end of the flat metal plate 70 in the length direction, and the electrode 14 is attached parallel with the electrode 12 near the other end of the flat metal plate 70 in the length direction. The flat metal plate 70, which is orthogonal to both the direction in which the electrodes 12 and 14 oppose one another (hereinafter also simply referred to as the "length direction" in this specification) and the direction of thickness of the flat metal plate 70, is curved with one edge in the width direction (the lower edge in FIG. 8) arcing at a constant curvature toward the center in the width direction, with a predetermined point which lies outside, to one side of, the flat metal plate 70 in the width direction (i.e., below the flat metal plate 70 in FIG. 8) serving as the center of curvature.

Also, the other edge of the flat metal plate 70 in the width direction (i.e., the upper edge in FIG. 8) is also curved, arcing in the same direction and with the same curvature radius as the other edge described above (i.e., the lower edge in FIG. 8). Therefore, although the width of the flat metal plate 70 does not change from the side where the electrode 12 is attached to the side where the electrode 14 is attached, the center of the flat metal plate 70 in the length direction is offset to the outside in the width direction.

The electrodes 12 and 14 are connected to the flat metal plate 70 structured as described above and that flat metal plate 70 is then heated by conduction in a heating process. When current is passed through the flat metal plate 70, it flows along the shortest path from the electrode 12 to the electrode 14. In this case, the center of the flat metal plate 70 is offset from the ends where the electrodes 12 and 14 are attached as described above, so the current density along one edge of the flat metal plate 70 in the width direction gradually increases toward the center of the flat metal plate 70 in the length direction (i.e., in this example embodiment, the area of the flat metal plate 70 between the electrodes 12 and 14 serves as the current density changing portion). Therefore, when the flat metal plate 70 is heated by passing current through it, one side with respect to the center in the width direction of the flat metal plate 70 can be heated to a high temperature.

Figure 9A:
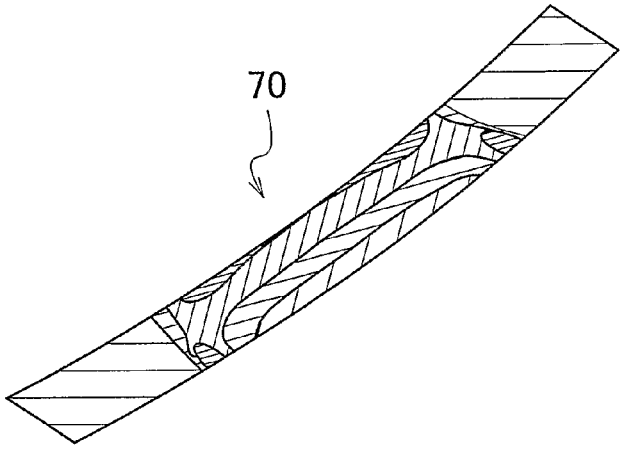
FIGS. 9A to 9C are perspective views showing the temperature distribution (i.e., the distribution over the quenchable region) of the plate by the press-forming method according to the fourth example embodiment of the invention.
Figure 9B:
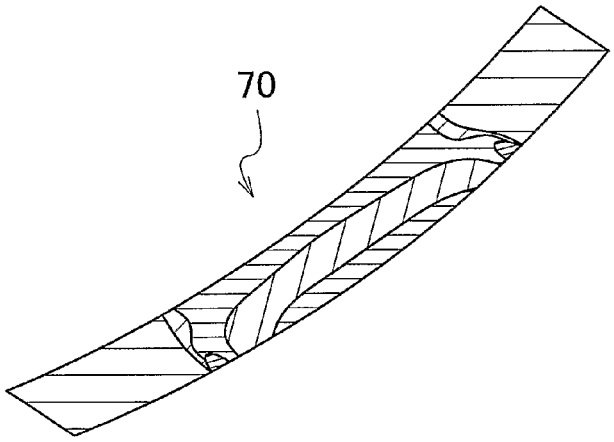
Figure 9C:
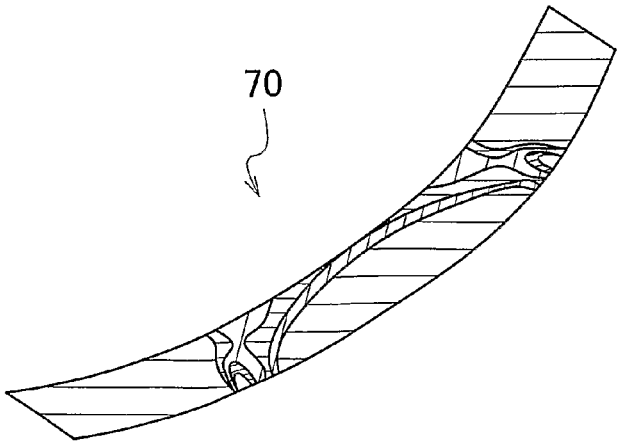

FIGS. 9A to 9C are perspective views showing the temperature distribution of the flat metal plate 70 that has been heated by passing current between the electrodes 12 and 14. In FIGS. 9A to 9C, the hatching indicates the temperature distribution, not the cross-section. Regions having hatching of the same width and in the same direction are regions of substantially the same temperature. Also, narrower hatching indicates a higher temperature.

A steel sheet to be quenched that is 1.2 mm thick is used for each flat metal plate 70 shown in FIGS. 9A to 9C. Also, the distance between the electrodes 12 and the electrodes 14 attached to the flat metal plates 70 shown in FIGS. 9A to 9C is 600 mm. Moreover, the width of the flat metal plate 70 which extends in a direction orthogonal to both the length direction and the direction of thickness of the flat metal plate 70 is the same for each flat metal plate 70 shown in FIGS. 9A to 9C.

However, the edges in the width directions of the flat metal plates 70 shown in FIGS. 9A to 9C each have a different curvature radius. Therefore, the offset dimensions at the edges (i.e., dimension L6 in FIG. 8) in the width direction (i.e., portion from the alternate and short dash line to the outer edge of the plat metal plate 70) are different with each flat metal plate 70. As a result, the reduction rate of the ratio of i) the sectional area of the flat metal plate 70 cut in the direction orthogonal to both the length direction and the direction of thickness of the flat metal plate 70 at the portions where the electrodes 12 and 14 are connected and ii) the sectional area of the flat metal plate 70 at the offset portion at the center in the length direction is different. That is, the reduction rate of the sectional area of the center portion in the length direction with respect to the portion where the electrodes 12 and 14 are connected is different.

More specifically, with the flat metal plate 70 shown in FIG. 9A, the curvature radius of the edge in the width direction of the flat metal plate 70 is 3,000 mm, and the reduction rate of the sectional area is 13%. In contrast, with the flat metal plate 70 shown in FIG. 9B, the curvature radius of the edge in the width direction of the flat metal plate 70 is 2,000 mm, and the reduction rate of the sectional area is 19%, and with the flat metal plate 70 shown in FIG. 9C, the curvature radius of the edge in the width direction of the flat metal plate 70 is 1,000 mm, and the reduction rate of the sectional area is 39%.

As shown in FIG. 9A, when the reduction rate of the sectional area at the center portion in the length direction with respect to the sectional area at the portions where the electrodes 12 and 14 are connected is 13% which is relatively small, the temperature difference between one side of the flat metal plate 70 in the width direction and the other side of the flat metal plate 70 in the width direction is small even though the temperature is higher on one side (i.e., the lower side in FIG. 8) than it is on the other. Therefore, a region approximately 95% of the flat metal plate 70 between the electrodes 12 and 14 can be heated to the quenchable temperature.

Also, as shown in FIG. 9B, when the reduction rate of the sectional area at the center portion in the length direction with respect to the sectional area at the portions where the electrodes 12 and 14 are connected is 19% which is relatively small, the temperature difference between one side of the flat metal plate 70 in the width direction and the other side of the flat metal plate 70 in the width direction is small even though the temperature is higher on one side (i.e., the lower side in FIG. 8) than it is on the other. Therefore, a region approximately 94% of the flat metal plate 70 between the electrodes 12 and 14 can be heated to the quenchable temperature.

In contrast, as shown in FIG. 9C, when the reduction rate of the sectional area at the center portion in the length direction with respect to the sectional area at the portions where the electrodes 12 and 14 are connected is 39% which is relatively large, the temperature in the offset region does not easily rise, so the change in the temperature distribution on one side of the flat metal plate 70 in the width direction and the other side of the flat metal plate 70 in the width direction across a straight line that connects the end portions of the flat metal plate 70 where the electrodes 12 and 14 are connected is significant.

In this way, with the press-forming method according to this example embodiment, a temperature change can be created in the flat metal plate 70 between one side of the flat metal plate 70 and the other side of the flat metal plate 70 in the width direction when heating the flat metal plate 70 by conduction in the heating process, by offsetting the center of the flat metal plate 70 in the length direction without changing the width of the flat metal plate 70. Therefore, a metal plate to be press-formed, which has a quenchable portion on one side in the width direction and a non-quenchable portion on the other side in the width direction, can be easily manufactured. Accordingly, a press-formed part of which a portion that corresponds to one side of the flat metal plate 70 in the width direction has been quenched by press-forming and rapidly cooling the flat metal plate 70 in the forming process can be easily manufactured.

Moreover, the flat metal plate 70 which has been heated by conduction in the heating process is press-formed in the forming process so the structure of the die 24, and more particularly, the cooling structure of the die 24, does not have to be complex, which enables the cost of the die and the like to be reduced. In this embodiment, the width of the center portion of the plate metal plate 70 may be narrower than that of the both end of the plate metal plate 70 on the electrodes 12 and 14 side.

Next, a fifth example embodiment of the invention will be described.

Figure 10:
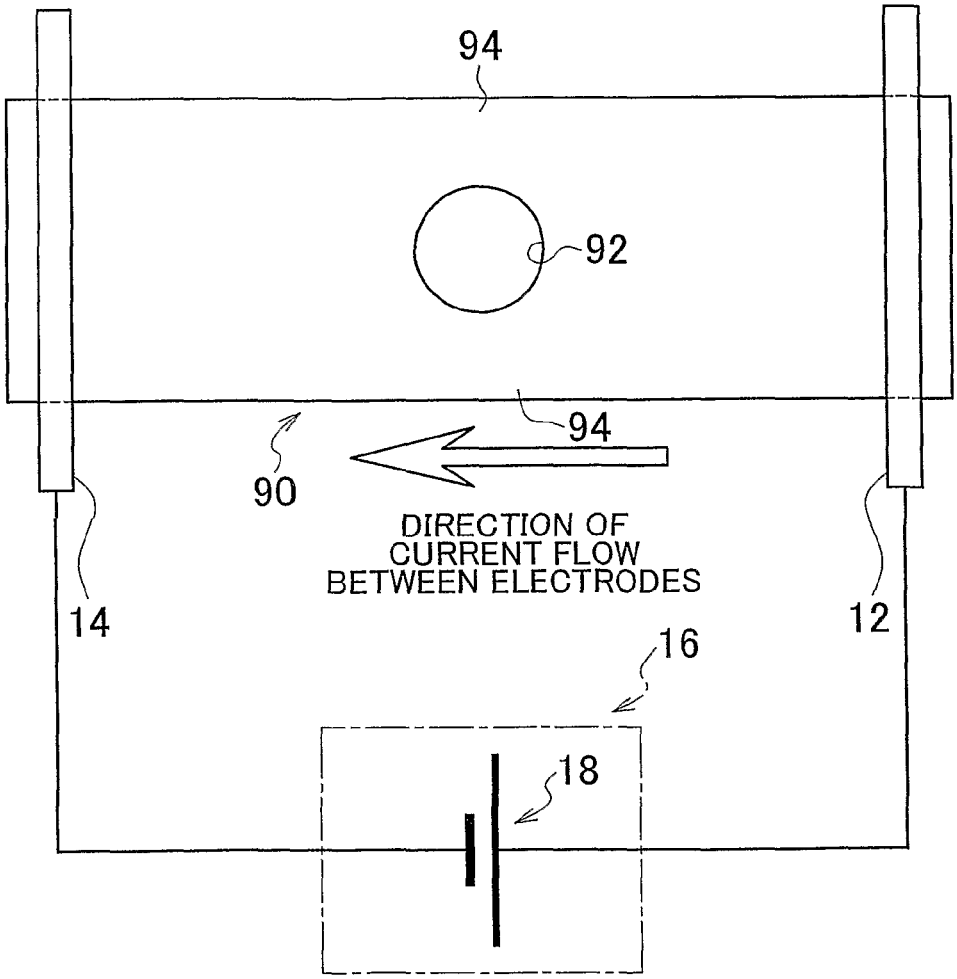
FIG. 10 is a view schematically showing a heating process in a press-forming method according to a fifth example embodiment of the invention.
Figure 11:
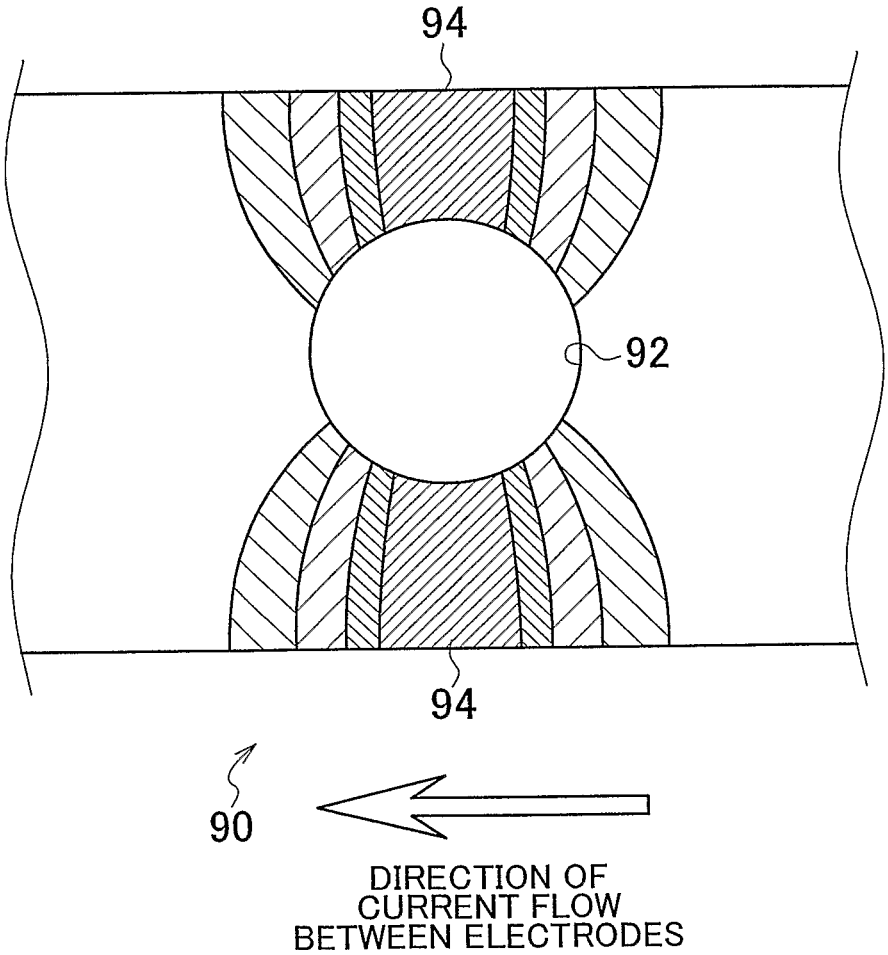
FIG. 11 is an enlarged plan view showing the temperature distribution (i.e., the distribution over the quenchable region) of the plate by the press-forming method according to the fifth example embodiment of the invention.

FIG. 10 is a view schematically showing a heating process in a press-forming method according to the fifth example embodiment of the invention. In this example embodiment, a flat metal plate 90 which serves as the plate is heat treated. As shown in FIG. 10, the flat metal plate 90 has a rectangular shape when viewed from above. The electrode 12 is attached to one end in the length direction and the electrode 14 is attached to the other end. Also, a circular hole 92 is formed in the thickness direction through the center of the flat metal plate 90 in both the length and width directions.

With this structure, the sectional area of the flat metal plate 90 cut in a direction orthogonal to the length direction of the flat metal plate 90 gradually decreases from the edges of the circular hole 92 in the length direction of the flat metal plate 90 toward the center. Therefore, the current density increases toward the center in the length direction of the flat metal plate 90 on the sides of the circular hole 92 in the width direction of the flat metal plate 90. That is, in this example embodiment, the side portions of the circular hole 92 in the width direction of the flat metal plate 90 serve as current density changing portions 94.

The electrodes 12 and 14 are connected to the flat metal plate 90 structured as described above and that flat metal plate 90 is then heated by conduction in a heating process. Basically, when current is passed through the flat metal plate 90, the current density is higher on the sides of the circular hole 92 in the width direction of the flat metal plate 90 than it is on the sides of the circular hole 92 in the length direction of the flat metal plate 90 because the sectional area of the flat metal plate 90 is less at the portions on the sides of the circular hole 92 (i.e., at the current density changing portion 94) in the width direction of the flat metal plate 90 than it is at the portions on the sides of the circular hole 92 in the length direction of the flat metal plate 90. Therefore, the temperature becomes higher on the sides of the circular hole 92 in the width direction of the flat metal plate 90 than it does on the sides of the circular hole 92 in the length direction of the flat metal plate 90.

Moreover, the sectional area of the flat metal plate 90 at the current density changing portions 94 becomes smaller toward the center of the circular hole 92 in the length direction of the flat metal plate 90 so the temperature becomes higher toward the center at the current density changing portion 94 than it does on both sides of the circular hole 92 in the length direction of the flat metal plate 90.

In this way, the portions corresponding to the sides of the circular hole 92 in the width direction of the flat metal plate 90 are quenched when the flat metal plate 90, which has been heated by conduction in the heating process, is press-formed and rapidly cooled in the forming process.

Forming the circular hole 92 next to a portion that is to be a quenchable portion in the width direction of the flat metal plate 90 enables a quenchable portion to be easily formed in a desired location. Also, quenchable portions of the flat metal plate 90 can easily be set by appropriately forming a plurality of circular holes 92 in the flat metal plate 90.

Moreover, the flat metal plate 90 which has been heated by conduction in the heating process is press-formed in the forming process so the structure of the die 24, and more particularly, the cooling structure of the die 24, does not have to be complex, which enables the cost of the die and the like to be reduced.

Incidentally, in this example embodiment, the current density changing portions 94 are created on the flat metal plate 90 by forming the circular hole 92 in the flat metal plate 90. Alternatively, however, a through-hole of any one of various shapes may be used instead of the circular hole 92.

Next, a sixth example embodiment of the invention will be described.

Figure 12:
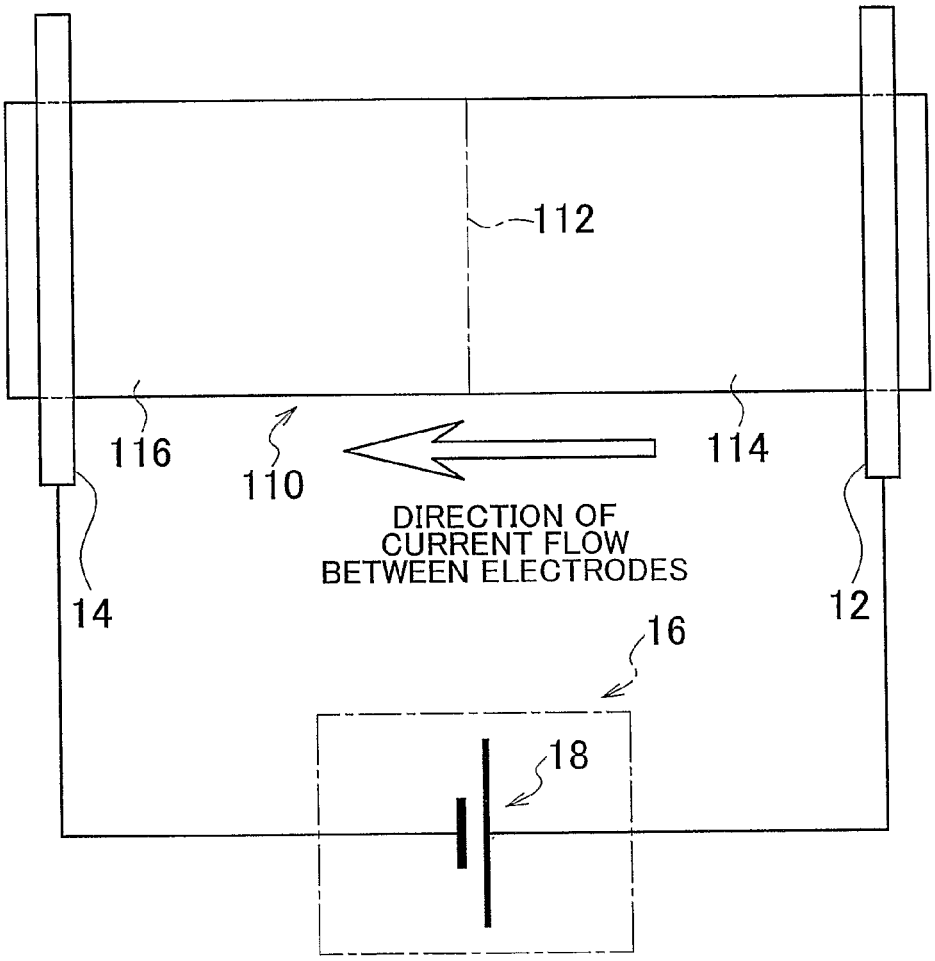
FIG. 12 is a view schematically showing a heating process in a press-forming method according to a sixth example embodiment of the invention.
Figure 13:
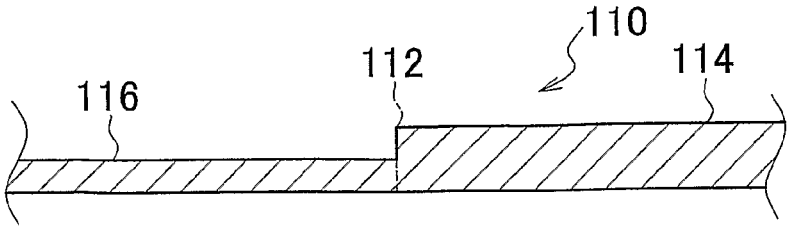
FIG. 13 is an enlarged sectional view of a plate shown in FIG. 12.

FIG. 12 is a view schematically showing a heating process in a press-forming method according to this example embodiment. In this example embodiment, a flat metal plate 110 which serves as the plate is heat treated. As shown in FIG. 12, the flat metal plate 110 has an entirely rectangular shape when viewed from above. The electrode 12 is attached to one end in the length direction and the electrode 14 is attached to the other end. Also, a predetermined location at the center portion in the length direction of the flat metal plate 110 (i.e., the location indicated by the alternate long and short dash line in FIG. 12) serves as a current density changing portion 112, as shown in FIG. 13. The side of the flat metal plate 110 on the electrode 12 side of the current density changing portion 112 is a thick plate portion 114 of a uniform thickness. The side of the flat metal plate 110 on the electrode 14 side of the current density changing portion 112 is a thin plate portion 116 of a uniform thickness. The thin plate portion 116 is thinner than the thick plate portion 114. The flat metal plate 110 is formed by welding a flat metal plate that serves as the thin plate portion 116 to a flat metal plate that serves as the thick plate portion 114.

Therefore, with the flat metal plate 110, the sectional area of the flat metal plate 110 changes at the current density changing portion 112 by the thick plate portion 114 and the thin plate portion 116 even though the width of the flat metal plate 110 between the electrode 12 and the electrode 14 does not change. As a result, the current density becomes higher on the thin plate portion 116 side than it does on the thick plate portion 114 side.

The electrodes 12 and 14 are connected to the flat metal plate 110 structured as described above and that flat metal plate 110 is then heated by conduction in a heating process. When current is passed through the flat metal plate 110, the current density increases in the thin plate portion 116 as described above so the temperature is able to be higher at the thin plate portion 116 than it is at the thick plate portion 114. In particular, when the thin plate portion 116 is 1.2 mm thick and the thick plate portion 114 is changed between 1.4 mm thick (a 17% increase rate in the sectional area with respect to the think plate portion 116), 1.6 mm thick (a 33% increase rate in the sectional area with respect to the think plate portion 116), 1.8 mm thick (a 50% increase rate in the sectional area with respect to the think plate portion 116), and 2.3 mm thick (a 92% increase rate in the sectional area with respect to the think plate portion 116), it was confirmed that the temperature of the thick plate portion 114 was less than 850° C. in each case, even when the thin plate portion 116 was heated to a temperature of between 850° C. and 950° C.

In this way, it is possible to heat only the thin plate portion 116 of the flat metal plate 110 to a quenchable temperature without changing the width of the flat metal plate 110 in the heating process, by making the center portion in the length direction the current density changing portion 112 and changing the thickness of the flat metal plate 110 so that the side with the electrode 12 is a different thickness than the side with the electrode 14. Therefore, it is possible to quench the portion corresponding to the thin plate portion 16 of the flat metal plate 110 by press-forming and rapidly cooling the flat metal plate 110, which has been heated by conduction in the heating process, in the forming process.

Moreover, the flat metal plate 110 which has been heated by conduction in the heating process is press-formed in the forming process so the structure of the die 24, and more particularly, the cooling structure of the die 24, does not have to be complex, which enables the cost of the die and the like to be reduced.

Next, a seventh example embodiment of the invention will be described.

Figure 14:
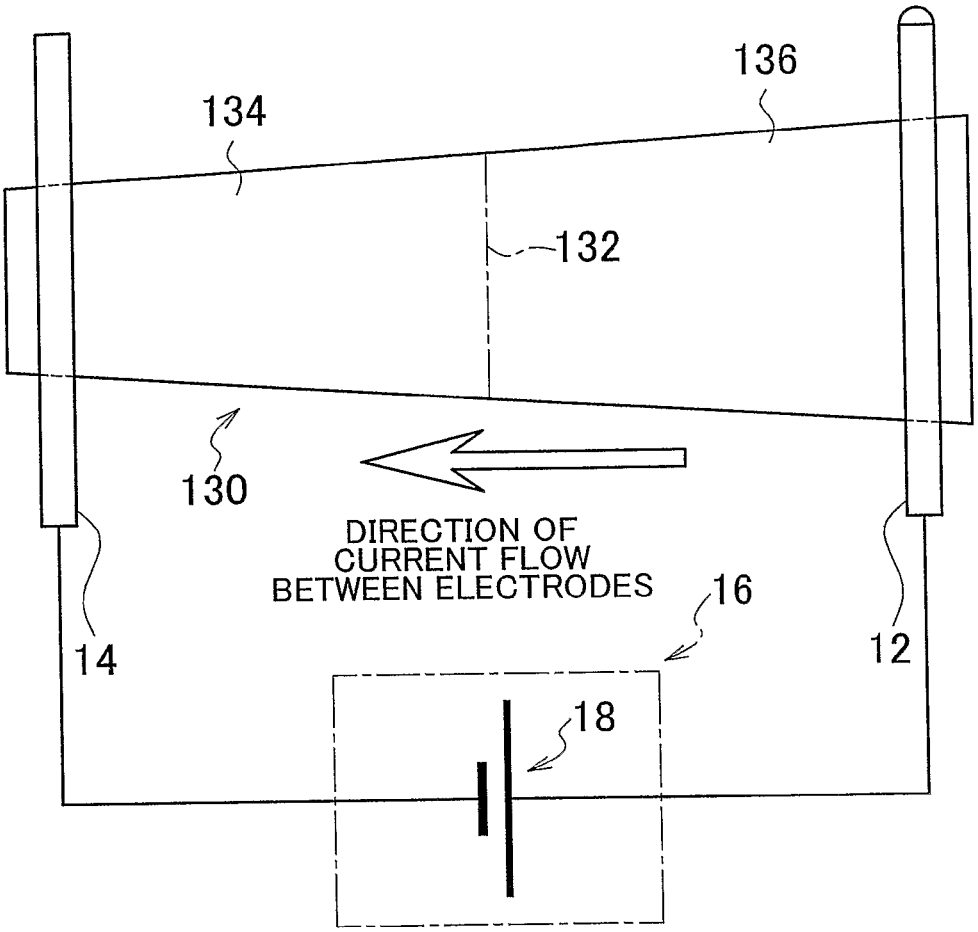
FIG. 14 is a view schematically showing a heating process in a press-forming method according to a seventh example embodiment of the invention.
Figure 15:
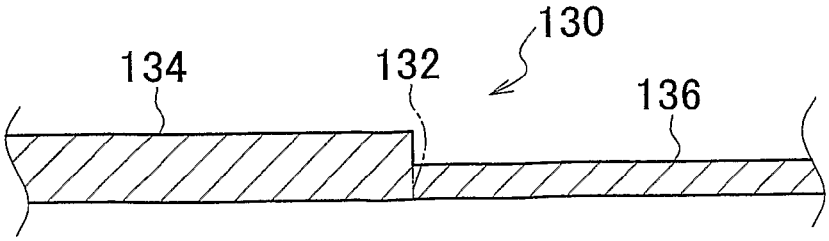
FIG. 15 is an enlarged sectional view of a plate shown in FIG. 14.

FIG. 14 is a view schematically showing a heating process in a press-forming method according to this example embodiment. In this example embodiment, a flat metal plate 130 which serves as the plate is heated by conduction. As shown in FIG. 14, the flat metal plate 130 has a trapezoidal shape when viewed from above, similar to the flat metal plate 10 in the first example embodiment. A current density changing portion 132 that is parallel to both the end of the flat metal plate 130 on the electrode 12 side and the end of the flat metal plate 130 on the electrode 14 side is created in the center portion of the flat metal plate 130 in the length direction. As shown in FIGS. 14 and 15, the side of the flat metal plate 130 that is on the electrode 14 side of the current density changing portion 132 is a thick plate portion 134 of a uniform thickness. In contrast, the side of the flat metal plate 130 that is on the electrode 14 side of the current density changing portion 132 is a thin plate portion 136 that is also of a uniform thickness which is thinner than the thick plate portion 134.

The electrodes 12 and 14 are connected to the flat metal plate 130 structured as described above and that flat metal plate 130 is then heated by conduction in a heating process. The flat metal plate 130 is similar to the flat metal plate 110 of the sixth example embodiment in that the thickness of the flat metal plate 130 on the electrode 12 side of the current density changing portion 132 that is in the center of the flat metal plate 130 in the length direction differs from the thickness of the flat metal plate 130 on the electrode 14 side of the current density changing portion 132. Therefore, when current is passed through the flat metal plate 130, the current density becomes higher at the thin plate portion 136 than it does at the thick plate portion 134, so the thin plate portion 136 is heated to a higher temperature than the thick plate portion 134 is. Meanwhile, the flat metal plate 130 has a trapezoidal shape when viewed from above, similar to the flat metal plate 10 of the first example embodiment.

Moreover, the current density changing portion 132 is parallel to both the end of the flat metal plate 130 on the electrode 12 side and the end of the flat metal plate 130 on the electrode 14 side, so the shape of the thin plate portion 136 when viewed from above is similar to the overall shape of the flat metal plate 130 when viewed from above, i.e., it is trapezoidal. Therefore, similar to the first example embodiment, the current density becomes higher on the shorter side, from among the two sides of the thin plate portion 136 that are parallel in the length direction, i.e., on the current density changing portion 132 side of the thin plate portion 136. Accordingly, the side of the thin plate portion 136 that is closer to the current density changing portion 132 is heated to a higher temperature than the side of the thin plate portion 136 that is closer to the electrode 12 in the length direction.

More specifically, when current flows through the plat metal plate 130 having the same shape as flat metal plate 110 shown in FIG. 2C when viewed from above, the thin plate portion 136 of the flat metal plate 130 is heated to a quenchable temperature, i.e., between 850° C. to 950° C., in a region that extends approximately 251 mm from the current density changing portion 132 toward the electrode 12 (though the thin plate portion 136 is not heated to the quenchable temperature in a region that extends approximately 7 mm from the current density changing portion 132 toward the electrode 12). Therefore, a region that extends from a position approximately 7 mm away from the current density changing portion 132 toward the electrode 12 to a position approximately 244 mm further away toward the electrode 12 is heated to the quenchable temperature.

In this way, it is possible to heat only the center portion on the electrode 12 side and the center portion on the electrode 14 side to the quenchable temperature by using the flat metal plate 130 that has a trapezoidal shape when viewed from above and has the current density changing portion 132 at the center portion in the length direction. Therefore, when the flat metal plate 130 which has been heated by conduction in the heating process is press-formed and rapidly cooled in the forming process, it is possible to quench only the portion corresponding to the center portion of the flat metal plate 130 on the electrode 12 side and the center portion of the flat metal plate 130 on the electrode 14 side.

Moreover, the flat metal plate 130 which has been heated by conduction in the heating process is press-formed in the forming process so the structure of the die 24, and more particularly, the cooling structure of the die 24, does not have to be complex, which enables the cost of the die and the like to be reduced.

Next, an eighth example embodiment of the invention will be described.

Figure 16:
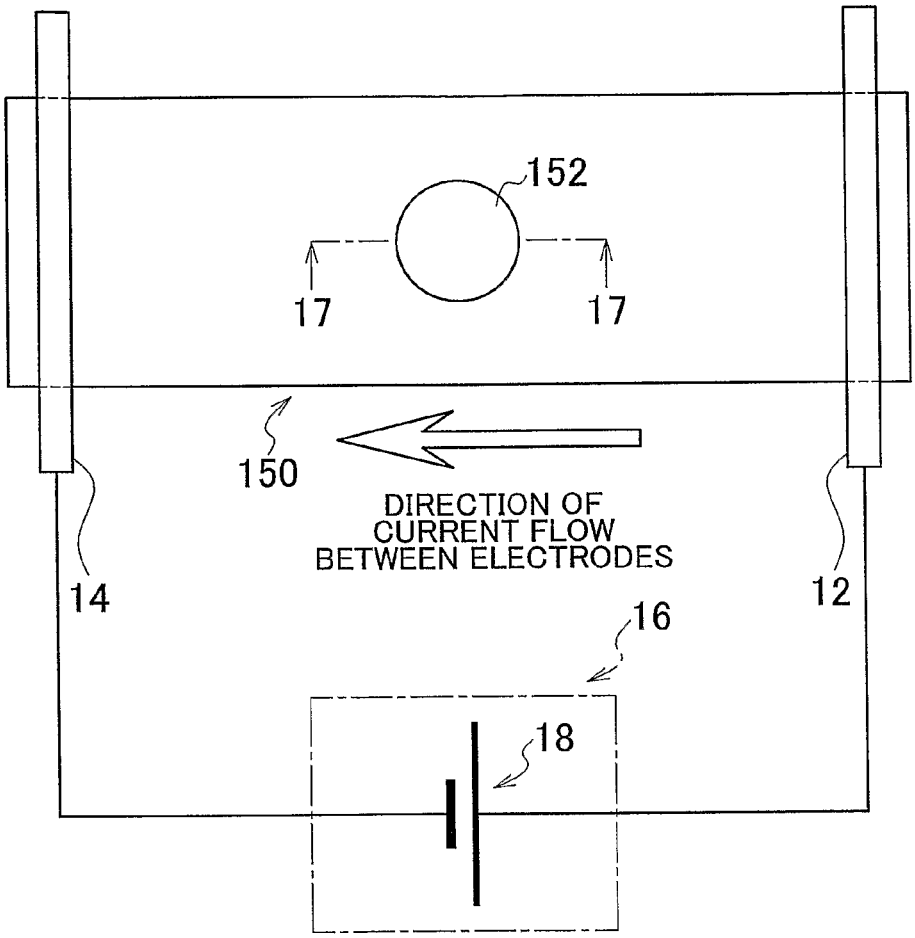
FIG. 16 is a view schematically showing a heating process in a press-forming method according to an eighth example embodiment of the invention.

FIG. 16 is a view schematically showing a heating process in a press-forming method according to this example embodiment. In this example embodiment, a flat metal plate 150 is heated by conduction. As shown in FIG. 16, the flat metal plate 150 has a rectangular shape when viewed form above. The electrode 12 is attached to one end of the flat metal plate 150 in the length direction and the electrode 14 is attached to the other end of the flat metal plate 150 in the length direction. Also, a current density changing portion 152 is formed in the center of the flat metal plate 150 in both the length and width directions.

As shown in FIG. 16, the current density changing portion 152 is circular when viewed from above. Also, the current density changing portion 152 is deformed such that it bulges out in the thickness direction of the flat metal plate 150 and is recess on the other side in the thickness direction, as shown in the enlarged sectional view of the area near the current density changing portion 152 cut along line 17-17 in FIG. 16. Furthermore, the thickness of the current density changing portion 152 becomes gradually thinner from both ends of the current density changing portion 152 in the length direction of the flat metal plate 150 (i.e., the edge of the opening of the current density changing portion 152 on the other side in the thickness direction of the flat metal plate 150) toward the center of the current density changing portion 152 in the length direction of the flat metal plate 150 (i.e., near the top of the bulge of the current density changing portion 152 toward the one side in the thickness direction of the flat metal plate 150).

Also, although not shown, the sectional shape of the current density changing portion 152 in the width direction of the flat metal plate 150 and the sectional shape of the current density changing portion 152 in the length direction of the flat metal plate 150, i.e., the sectional shape of the current density changing portion 152 cut along line 17-17 in FIG. 16, are generally the same. This current density changing portion 152 is formed by pressing the flat metal plate 150 from the other side in the thickness direction using a cylindrical punch or the like, for example.

Figure 17:
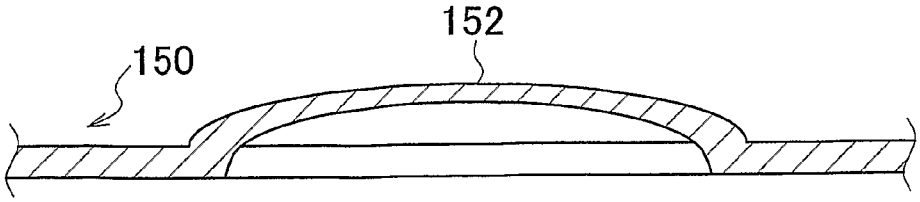
FIG. 17 is an enlarged sectional view of a plate shown in FIG. 16.

The electrodes 12 and 14 are connected to the flat metal plate 150 structured as described above and that flat metal plate 150 is then heated by conduction in a heating process. When current is passed through the flat metal plate 150, the current density becomes higher at the current density changing portion 152 because the sectional area of the flat metal plate 150 is less at the current density changing portion 152 which is circular when viewed from above than it is at other portions of the flat metal plate 150. Therefore, as shown in FIG. 17, the temperature becomes higher at the current density changing portion 152 than it does at other portions of the flat metal plate 150. In addition, as described above, the current density changing portion 152 becomes thinner closer to the center of the current density changing portion 152 when viewed from above so the temperature becomes the greatest at the center of the current density changing portion 152 when viewed from above, and decreases toward the outside of the flat metal plate 150.

Furthermore, as described above, the temperature becomes the highest at the center of the current density changing portion 152 when viewed from above, and that region extends out farther in the width direction of the flat metal plate 150 than it does in the length direction of the flat metal plate 150, i.e., in the direction in which the electrodes 12 and 14 oppose one another. Moreover, when the entire region of the current density changing portion 152 and the area therearound in the width direction of the flat metal plate 150 is heated to a quenchable temperature, i.e., between 850° C. and 950° C., the region of the quenchable temperature in the length direction of the flat metal plate 150 has been confirmed by the inventors to extend from the center of the current density changing portion 152 to a portion where the rate of change in the thickness compared with other portions of the current density changing portion 152 is up to approximately 10%.

Therefore, a desired portion of the flat metal plate 150 in the length direction can easily be heated to a quenchable temperature by forming the current density changing portion 152 by a punch or the like as described above. Therefore, the current density changing portion 152 of the flat metal plate 150 and the area around that current density changing portion 152 can be quenched by press-forming and rapidly cooling the flat metal plate 150, which has been heated by conduction in the heating process, in the forming process.

Moreover, the flat metal plate 150 which has been heated by conduction in the heating process is press-formed in the forming process so the structure of the die 24, and more particularly, the cooling structure of the die 24, does not have to be complex, which enables the cost of the die and the like to be reduced.

Next, example embodiments of a press-formed part based on the first to eighth example embodiments described above will be described as ninth and tenth example embodiments of the invention based on the example embodiments described above.

Figure 18:
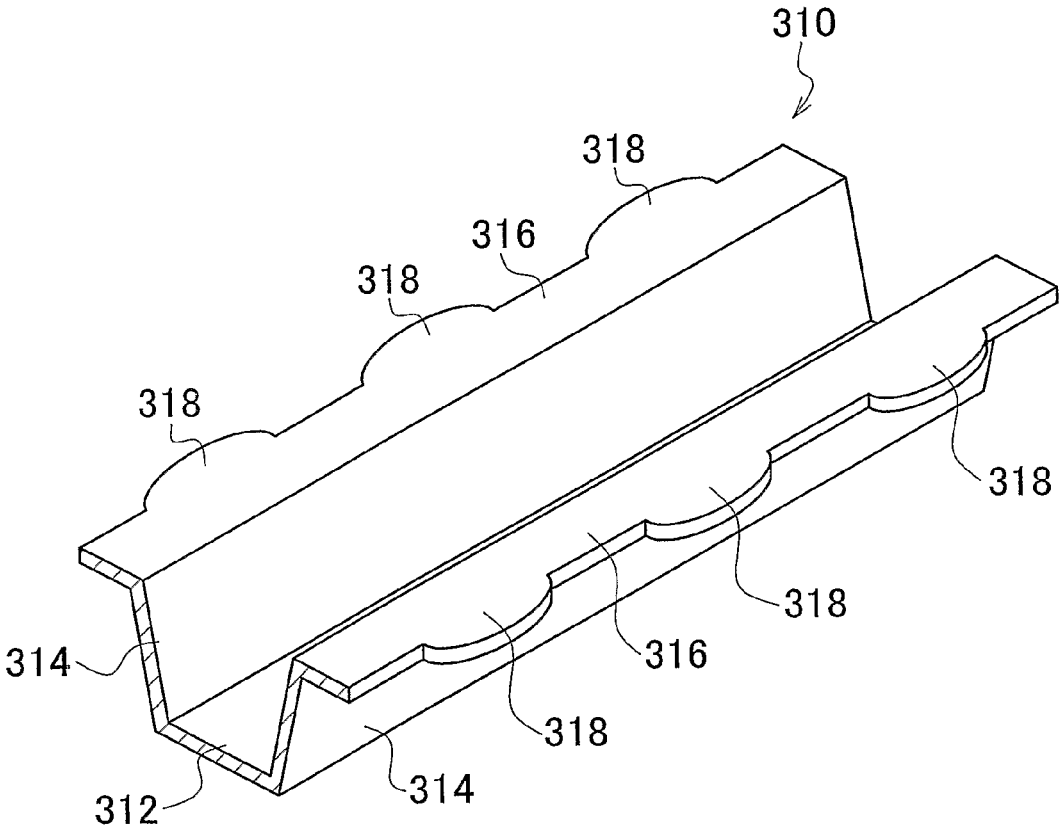
FIG. 18 is a perspective view of a press-formed part according to a ninth example embodiment of the invention.

FIG. 18 is a perspective view of the structure of a press-formed part 310 according to a ninth example embodiment of the invention formed by appropriately applying one of the press-forming methods described in the first to the eighth example embodiments described above. This press-formed part 310 has a so-called sectional hat shape, and may be applied to a vehicle body frame or a structural member for reinforcing a vehicle body (such as a rocker provided near a door opening of a vehicle, for example).

More specifically, as shown in FIG. 18 the press-formed part 310 has a flat plate portion 312. Leg plate portions 314 are formed extending from the edges of the flat plate portion 312 in the width direction. These leg plate portions 314 are inclined toward the outside in the width direction of the flat plate portion 312 on one side in the thickness direction of the flat plate portion 312. A flange portion 316 extends out toward the outside in the width direction of the flat plate portion 312 from the edge of each leg plate portion 314 that is opposite the edge of the leg plate portion 314 that is attached to the flat plate portion 312. In addition, a plurality of welded protrusions 318 are formed on the edges of the flange portions 316 that are opposite the edges of the flange portions 316 that are connected to the leg plate portions 314. These welded protrusions 318 extend toward the outside in the width direction of the flat plate portion 312 from the edges of the flange portions 316 that are opposite the edges of the flange portions 316 that are connected to the leg plate portions 314, at predetermined intervals in the length direction of the flat plate portion 312. These welded protrusions 318 are curved such that the edges of the welded protrusions 318 that are opposite the portions of the welded protrusions 318 that are connected to the flange portions 316 bulge outward in the width direction of the flat plate portions 312 from the edges of the flange portions 316.

Figure 19:
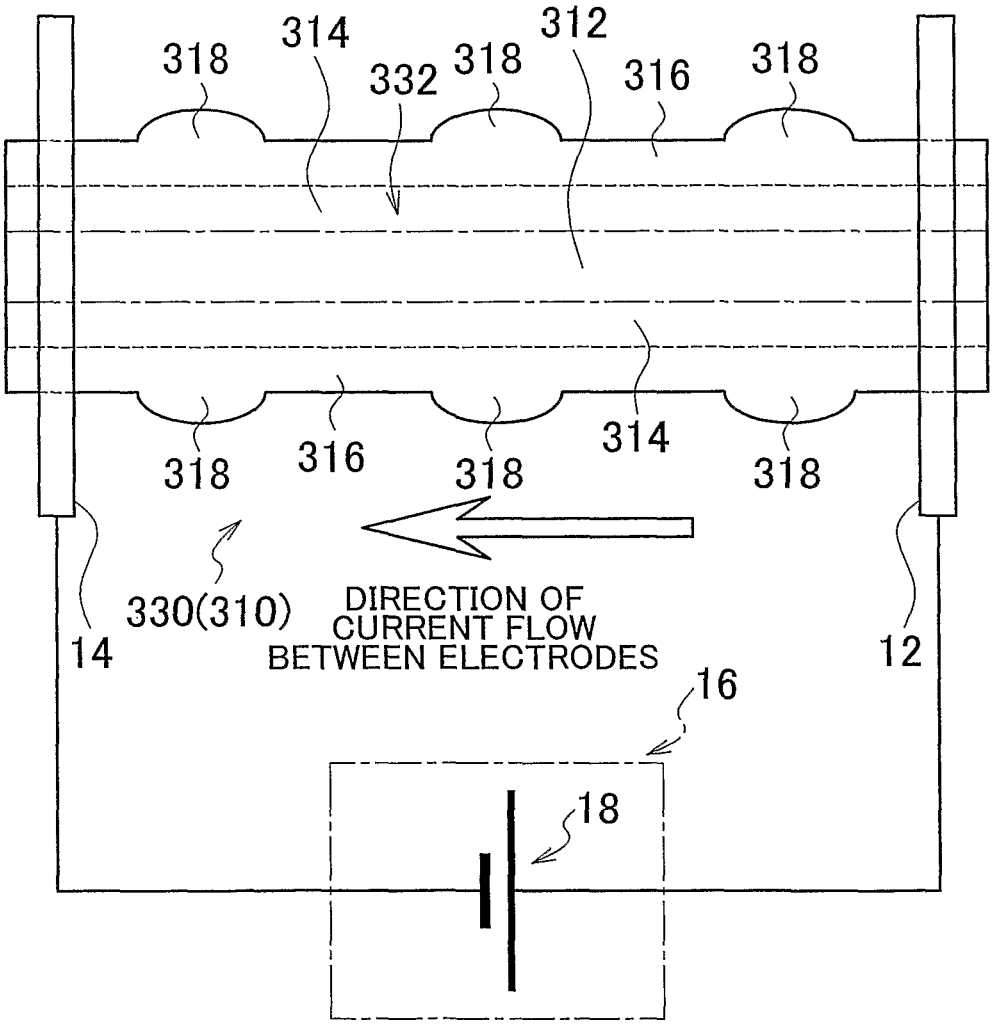
FIG. 19 is a view schematically showing a heating process in a press-forming method applied to a plate in order to form the press-formed part according to the ninth example embodiment of the invention.

The press-formed part 310 having this kind of structure is formed by press-forming a flat metal plate 330 that serves as the plate shown in FIG. 19. The flat metal plate 330 has a base portion 332 that is rectangular when viewed from above. The electrode 12 is connected to one end of the base portion 332 in the length direction, and the electrode 14 is connected to the other end of the base portion 332 in the length direction. The flat plate portion 312, the leg plate portions 314, and the flange portions 316 described above are formed by press-forming this base portion 332. Moreover, the welded protrusions 318 extend out from both edges of this base portion 332 in the width direction.

When forming this press-formed part, the flat metal plate 330 is heated by passing current through the flat metal plate 330 in a heating process that corresponds to the heating process in the example embodiments described above. Here, for example, even if current is passed through the flat metal plate 330, the current density is lower at the portions that extend (bulge) outward in the width direction from the edges of the base portion 332 in the width direction where the electrodes 12 and 14 are attached, as described in the fourth example embodiment. That is, in the flat metal plate 330, even if the base portion 332 is heated to a quenchable temperature, such as between 850° C. and 950° C., the welded protrusions 318 will not reach the quenchable temperature.

Therefore, forming the press-formed part 310 by press-forming and rapidly cooling the flat metal plate 330, which has been heated by conduction in this way, in a forming process that corresponds to one of the forming processes in the example embodiments described above quenches the flat plate portion 312, the leg plate portions 314, and the flange portions 316, thereby dramatically improving the mechanical strength. Furthermore, even if the flat metal plate 330 is heated by conduction as described above, the welded protrusions 318 will not reach the quenchable temperature, so it is possible to effectively prevent or minimize a decrease in weld properties at the welded protrusions 318 that occurs due to quenching.

In this way, with this press-formed part 330, it is possible to quench the flat plate portion 312, the leg plate portions 314, and the flange portions 316 which together form a hat shape, without quenching the welded protrusions 318. Moreover, only the base portion 332 of the flat metal plate 330, which corresponds to the flat plate portion 312, the leg plate portions 314, and the flange portions 316 is heated to a quenchable temperature so localized cooling during press-forming is not necessary, obviating the need for a complex cooling structure.

Figure 20:
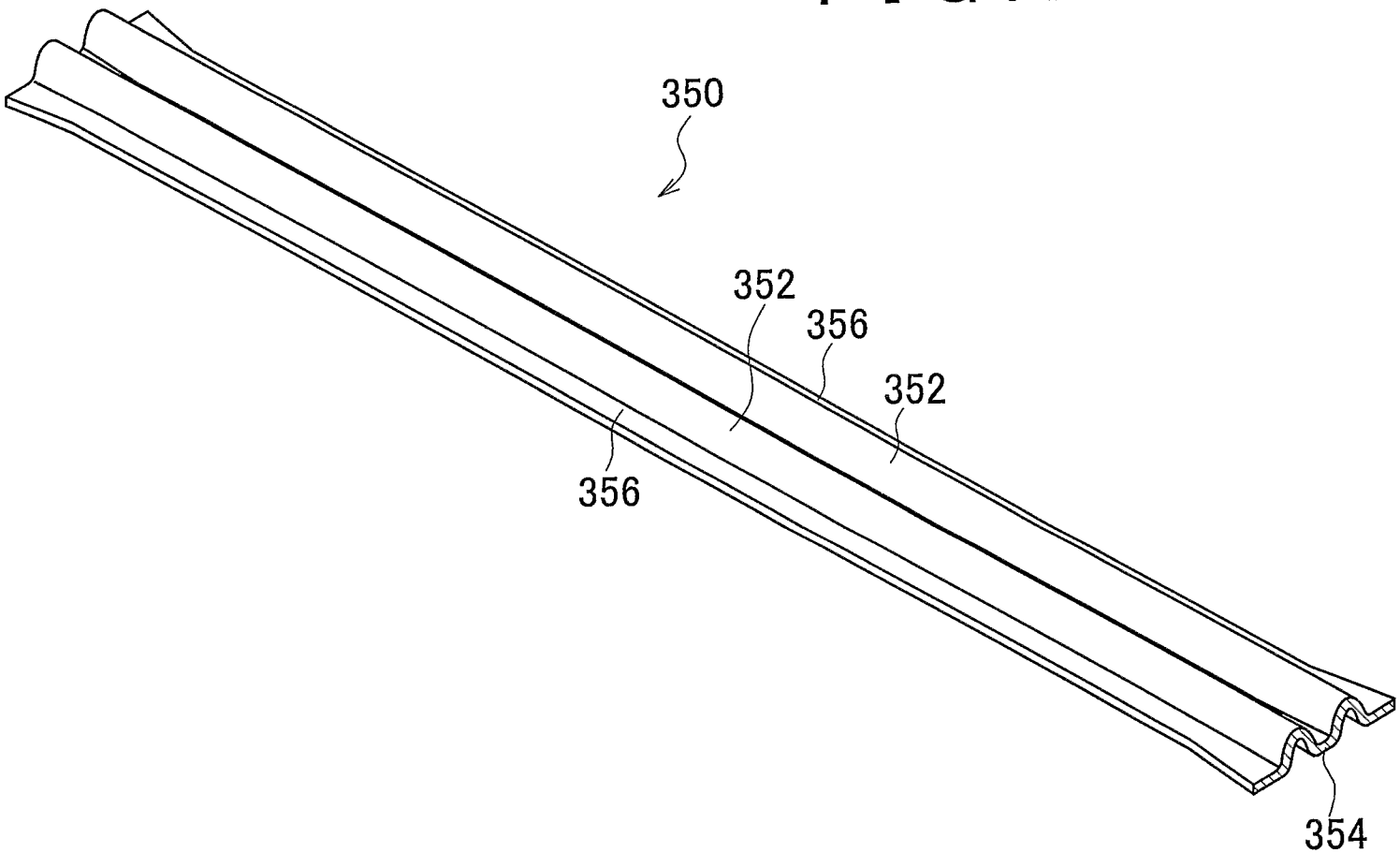
FIG. 20 is a perspective view of a press-formed part according to a tenth example embodiment of the invention.

FIG. 20 is a perspective view of the structure of a press-formed part 350 according to a tenth example embodiment of the invention, which is formed by appropriately applying one of the press-forming methods described in the first to the eighth example embodiments described above. This press-formed part 350 is so-called hat-shaped and may be applied to a vehicle body frame or a structural member for reinforcing a vehicle body (such as an impact beam provided on a door panel of a vehicle, for example).

More specifically, as shown in FIG. 20 the press-formed part 350 has a pair of curved portions 352. The curved portions 352 are curved with the sectional shape when cut in the width direction being such that it bulges out toward one side in the thickness direction and opens in a U-shape toward the other side, with the center of curvature located on the other side in the thickness direction. These curved portions 352 are arranged at predetermined intervals in the width direction. A flat plate portion 354 connects one of the curved portions 352 with the other curved portion 352. Flange portions 356 extend out in the same direction as the width direction of the flat plate portion 354 from the edges of the curved portions 352 that are on the sides of the curved portions 352 opposite, in the width direction, the sides of the curved portions 352 where the flat plate portion 354 is attached. A predetermined region toward the center of this press-formed part 350 in the length direction from both ends of the press-formed part 350 in the length direction is rust-proofed.

Figure 21:
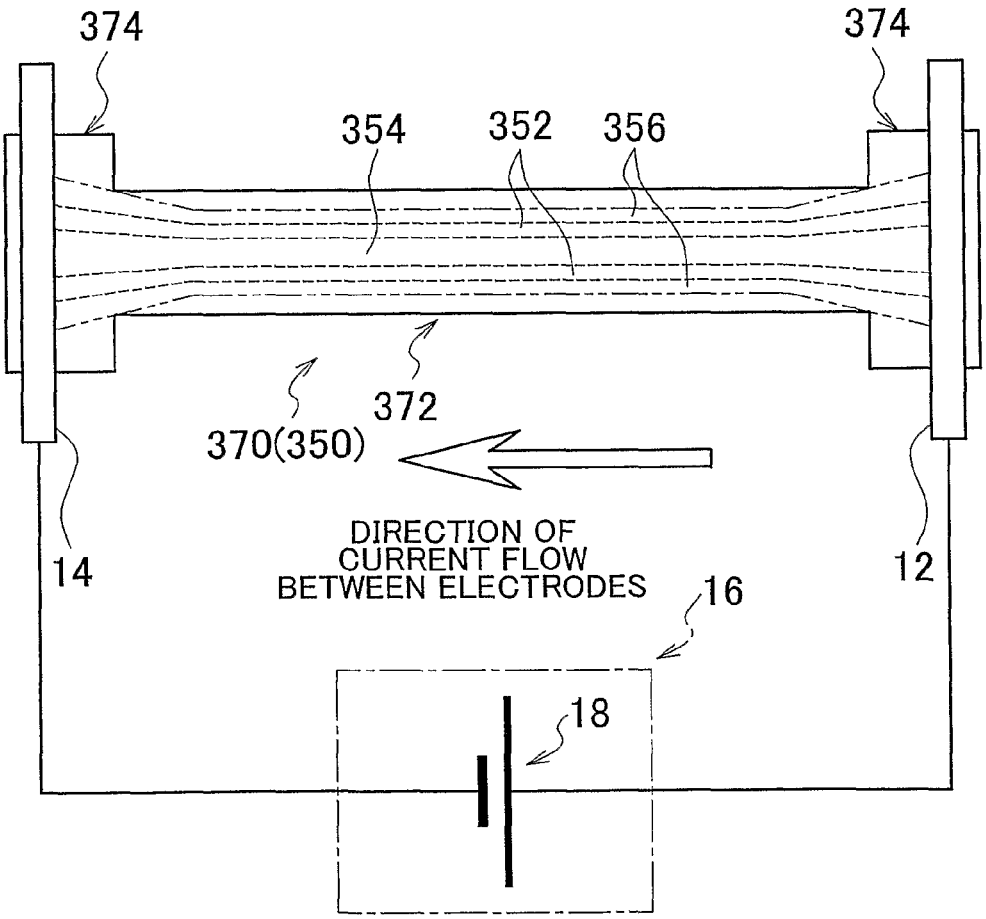
FIG. 21 is a view schematically showing a heating process in a press-forming method applied to a plate in order to form the press-formed part according to the tenth example embodiment of the invention.

Also, the press-formed part 350 structured as described above is formed by press-forming a flat metal plate 370 shown in FIG. 21. The flat metal plate 370 has a base portion 372 that is rectangular when viewed from above. A wide portion 374 is formed on each end of this base portion 372 in the length direction. These wide portions 374 are flat and have the same thickness as the base portion 372. However, the dimension of each wide portion 374 in the width direction of the base portion 372 is greater than the width of the base portion 372, such that both ends of the wide portions 374 in the width direction of the base portion 372 extend out further in the width direction than both ends in the width direction of the base portion 372.

The electrode 12 is connected to a wide portion 374 on one side of the base portion 372 in the length direction, and the electrode 14 is connected to the wide portion 374 on the other side of the base portion 372. The curved portions 352, the flat plate portion 354, and the flange portions 356 are formed by press-forming this flat metal plate 370.

When forming this press-formed part 350, the flat metal plate 370 is heated by passing current through the flat metal plate 370 in a heating process that corresponds to the heating process in one of the example embodiments described above. Here, for example, just as described in the second example embodiment, the width of the base portion 372 is shorter than the widths of the wide portions 374 where the electrodes 12 and 14 are connected, so the current density becomes higher at the base portion 372. That is, even if the base portion 372 of the flat metal plate 370 is heated to a quenchable temperature, such as between 850° C. and 950° C., the wide portions 374 will not reach the quenchable temperature.

Therefore, when forming the press-formed part 350 by press-forming and rapidly cooling (i.e., cooling) the flat metal plate 370, which has been heated by conduction, in a forming process that corresponds to the forming process in one of the example embodiments described above in this way, the portions of the press-formed part 350 that correspond to the wide portions, i.e., a predetermined region of the press-formed part 350 from both ends in the length direction toward the center in the length direction, are not quenched, while the portion corresponding to the base portion 372 of the press-formed part 350 is quenched. As a result, the mechanical strength is dramatically improved at the portion excluding the predetermined region of the press-formed part 350 from both ends in the length direction toward the center in the length direction.

Moreover, as described above, even if the flat metal plate 370 is heated, the wide portions 374 will not be heated to the quenchable temperature. Therefore, because the portion of the press-formed part 350 that corresponds to the wide portions 374, i.e.; the predetermined region of the press-formed part 350 from both ends in the length direction toward the center in the length direction, is not quenched, that portion is able to be highly resistant to rusting.

In this way, with this press-formed part 350, the portion that has not been rust-proofed is quenched so that it has greater mechanical strength, and the portion that has been rust-proofed is not quenched. Moreover, only the base portion 372 of the flat metal plate 370, which corresponds to the curved portions 352, the flat plate portion 354, and the flange portions 356, is heated to the quenchable temperature. Therefore, localized cooling is not necessary during press-forming, so there is no need for a complex cooling structure.

While the invention has been described with reference to example embodiments thereof, it is to be understood that the invention is not limited to the example embodiments or constructions. To the contrary, the invention is intended to cover various modifications and equivalent arrangements. In addition, while the various elements of the example embodiments are shown in various combinations and configurations, which are exemplary, other combinations and configurations, including more, less or only a single element, are also within the spirit and scope of the invention.

The invention claimed is:

1. A press-forming method comprising:

shaping a plate to include a first portion having a first width, a second portion having a second width greater than the first width, a trapezoidal portion that connects the first portion and the second portion, and a current density changing portion at a corner of the first portion that is adjacent to the trapezoidal portion;

performing a heating process of connecting an electrode to one end of the plate in a direction orthogonal to the thickness direction of the plate and connecting another electrode to an other end of the plate in the direction orthogonal to the thickness direction of the plate, and heating the plate by passing current from the one end to the other end; and forming the plate into a final predetermined shape by pressing and cooling the plate after the heating process, wherein shaping the plate includes:

determining an area of a section of the first portion having a width equal to the first width and a length equal to a difference between the first width and the second width, determining a reference proportion of the area of the section, determining an inclination angle between a length direction of the plate and an edge of the trapezoidal portion in a width direction of the plate according to the reference proportion of the area of the section, and shaping the plate to include the edge of the trapezoidal portion positioned at the inclination angle to form the corner of the first portion that is adjacent to the trapezoid portion such that a region around the corner is a region of the plate heated to a quenchable temperature during the heating process with an area that is a proportion of the area of the section equal to the reference proportion, wherein a current density of the current density changing portion is different than a current density at other portions of the plate while the current is passing through the plate to provide a temperature distribution in the plate that is controlled such that the plate is not heated uniformly prior to the forming of the plate, and wherein decreasing the inclination angle for the edge of the trapezoidal portion widens and increases the area of the region of the plate that is heated to the quenchable temperature.

2. The press-forming method according to claim 1, wherein the heating process is performed with a portion of the plate where a sectional area when the plate is cut in a direction orthogonal to a direction of current flow from the one end of the plate to the other end of the plate is different than a sectional area of an other portion of the plate and provides the current density changing portion.

3. The press-forming method according to claim 1, wherein a width of the plate is gradually reduced from a one end side toward an other end side of the plate in a direction of current flow to provide the current density changing portion, wherein a current density at the other end side is higher than a current density at the one end side.

4. The press-forming method according to claim 1, wherein a thickness at one portion of the plate is different from a thickness at an other portion of the plate in a direction of current flow from the one end of the plate toward the other end of the plate to provide the current density changing portion.

5. The press-forming method according to claim 1, wherein at least one of welding, working, and rust-proofing is performed in a portion of the plate which is not quenched or a portion which is quenched to a lesser degree in the heating process and the forming of the plate than the region of the plate heated to the quenchable temperature.

6. The press-forming method according to claim 5, wherein the working is at least one of bending and punching.

7. The press-forming method according to claim 1, wherein the temperature distribution is controlled so that the current density changing portion has a temperature higher than a rest of the plate.

8. The press-forming method according to claim 1, wherein the heating process forms a quenchable region of the plate that corresponds to a first end of the plate including the current density changing portion and forms a non-quenchable region of the plate that corresponds to a second end of the plate opposite to the first end, and the cooling the plate during the forming of the plate quenches only the quenchable region.

9. The press method according to claim 1, wherein shaping the plate includes adjusting the inclination angle between 15 and 90 degrees to adjust the current density of the current density changing portion.

10. A press-forming method comprising:

determining a reference proportion for an area of a plate to be heated to a quenchable temperature relative to an area of another portion of the plate;

preparing the plate to include a first portion, a second portion longer than the first portion along a first direction, a trapezoidal portion with a pair of sides connecting the first portion and the second portion along a second direction orthogonal to the first direction, and a region of an area between the first portion and the trapezoidal portion that is to be heated to the quenchable temperature;

connecting a first electrode to one end of the plate in a direction orthogonal to a thickness direction of the plate and connecting a second electrode to an other end of the plate in the direction orthogonal to the thickness direction of the plate;

heating the region to the quenchable temperature by passing current from the one end to the other end; and forming the plate into a final predetermined shape by pressing and cooling the plate after the heating, wherein preparing the plate to include the region includes positioning at least one of the pair of sides of the trapezoidal portion at an inclination angle corresponding to the reference proportion, wherein the inclination angle is an angle of the at least one of the pair of sides of the trapezoidal portion relative to the second direction, wherein positioning the at least one of the pair of sides of the trapezoidal portion at a smaller inclination angle increases a size of the region of the area between the first portion and the trapezoidal portion.

11. A press-forming method comprising:

determining a reference proportion for an area of a plate to be heated to a quenchable temperature relative to an area of another portion of the plate, preparing the plate to have a trapezoidal shape and to include a first side, a second side parallel to and shorter than the first side in a first direction, and a region of an area extending from the second side to the first side that is to be heated to the quenchable temperature;

connecting a first electrode to the first side of the plate and connecting a second electrode to the second side;

heating only the region to the quenchable temperature by passing current from the first side to the second side; and forming the plate into a final predetermined shape by pressing and cooling the plate after the heating, wherein the region spreads from the second side to the first side in a second direction orthogonal to the first direction over a length that is less than a length of the plate between the second side and the first side in the second direction, wherein preparing the plate to include the region includes sizing a length of the second side relative to a length of the first side according to a ratio corresponding to the reference proportion, wherein sizing the length of the second side according to a smaller ratio increases an area of the region.

* * * * *